US007131221B2

(12) United States Patent
Schmeichel

(10) Patent No.: US 7,131,221 B2
(45) Date of Patent: Nov. 7, 2006

(54) SELF-ADJUSTING SNOW PLOW

(75) Inventor: Charles M. Schmeichel, Jamestown, ND (US)

(73) Assignee: Agri-Cover, Inc., Jamestown, ND (US)

( * ) Notice: Subject to any disclaimer, the term of this patent is extended or adjusted under 35 U.S.C. 154(b) by 0 days.

(21) Appl. No.: 10/850,151

(22) Filed: May 19, 2004

(65) Prior Publication Data

US 2005/0016033 A1 Jan. 27, 2005

Related U.S. Application Data

(63) Continuation-in-part of application No. 10/404,164, filed on Mar. 31, 2003, now Pat. No. 6,817,118, and a continuation of application No. 10/841,740, filed on May 7, 2004.

(51) Int. Cl.
*E01H 5/04* (2006.01)

(52) U.S. Cl. ..... 37/232; 37/231; 37/267; 172/811

(58) Field of Classification Search ..... 37/232, 37/233, 31, 264, 266, 267; 172/811, 817
See application file for complete search history.

(56) References Cited

U.S. PATENT DOCUMENTS

| | | | | |
|---|---|---|---|---|
| 1,142,677 | A | 6/1915 | Darols | |
| 1,805,933 | A | 5/1931 | Victor | |
| 2,231,875 | A | 2/1941 | Behnke et al. | |
| 2,460,348 | A * | 2/1949 | Henry | 172/832 |
| 3,466,766 | A | 9/1969 | Kahlbacher | |
| 3,477,149 | A | 11/1969 | Wagner | |
| 3,545,109 | A | 12/1970 | Boschung | |
| 4,127,951 | A | 12/1978 | Hatch | |
| 4,249,323 | A * | 2/1981 | Mathis et al. | 37/232 |
| 4,357,766 | A | 11/1982 | Croteau et al. | |
| 4,446,639 | A * | 5/1984 | Bohn | 37/280 |
| 4,843,744 | A | 7/1989 | Jansen | |
| 4,944,104 | A | 7/1990 | Kowalcyzk | |
| 5,044,098 | A | 9/1991 | Berghefer | |
| 5,075,985 | A | 12/1991 | Mensch | |

(Continued)

FOREIGN PATENT DOCUMENTS

| | | |
|---|---|---|
| DE | 3334121 | 4/1984 |

(Continued)

*Primary Examiner*—Thomas A Beach
(74) *Attorney, Agent, or Firm*—Moore & Hansen, PLLP; Robert C. Freed

(57) ABSTRACT

A self-adjusting snow plow for use with pickup trucks and sport utility vehicles is disclosed. The snow plow includes a mounting apparatus for attachment to a vehicle and a plow blade having first and second ends, a top, a bottom, a plurality of retention members and a rubber scraper. The mounting apparatus preferably includes a pair of mounting uprights and a hitch tongue which is easily mounted in a hitch receiver which is secured to the front of a vehicle. The retention members are preferably constructed and arranged to at least partially encircle and slideably engage one of the respective mounting uprights and the retention members allow the respective ends of the plow blade to slide upward relative to the mounting upright most proximate to that end of the plow while the other end of the plow remains generally in the same position relative to the mounting upright proximate that end of the plow blade. The preferred retention members also permit the bottom of the plow blade to pivot away from the respective mounting uprights when the plow blade is engaged with the mounting apparatus in a working orientation and the vehicle is in motion in a direction rearward of the plow blade.

85 Claims, 27 Drawing Sheets

U.S. PATENT DOCUMENTS

| | | | | |
|---|---|---|---|---|
| 5,109,618 | A | 5/1992 | Grubler et al. | |
| 5,136,795 | A | 8/1992 | Rosenberg | |
| 5,297,351 | A | 3/1994 | Cote | |
| 5,509,219 | A | 4/1996 | Mecca | |
| 5,560,129 | A | 10/1996 | Rothbart | |
| 5,595,007 | A | 1/1997 | Biance | |
| 5,706,591 | A | 1/1998 | Wissmiller | |
| 5,724,755 | A | 3/1998 | Weagley | |
| 5,743,032 | A | 4/1998 | Vauhkonen | |
| 5,909,960 | A | 6/1999 | Jager et al. | |
| 5,950,336 | A | 9/1999 | Liebl | |
| 5,960,569 | A | 10/1999 | Molstad | |
| 5,967,241 | A | 10/1999 | Cross et al. | |
| 6,009,642 | A | 1/2000 | Nugent | |
| 6,094,845 | A | 8/2000 | Lela | |
| 6,102,131 | A | 8/2000 | Malinowski | |
| 6,112,438 | A | 9/2000 | Weagley | |
| 6,202,328 | B1 | 3/2001 | Fulton | |
| 6,240,658 | B1 | 6/2001 | Knutson et al. | |
| 6,240,660 | B1 | 6/2001 | Dugas | |
| 6,425,196 | B1 * | 7/2002 | Weagley et al. | 37/270 |
| 6,618,965 | B1 | 9/2003 | Schultz et al. | |
| 6,817,118 | B1 * | 11/2004 | Schmeichel | 37/232 |

FOREIGN PATENT DOCUMENTS

| | | |
|---|---|---|
| DE | 3319223 | 7/1984 |

* cited by examiner

SELF-ADJUSTING SNOW PLOW

RELATED APPLICATIONS

The present application is related to and claims priority to both U.S. patent application Ser. No. 10/404,164, filed Mar. 31, 2003, now issued as U.S. Pat. No. 6,817,118 and co-pending U.S. patent application Ser. No. 10/841,740, filed May 7, 2004, both entitled Self-Adjusting Snow Plow, which claim priority to PCT application No. PCT/US01/47125 for SELF-ADJUSTING SNOW PLOW filed Nov. 12, 2001, each of which are hereby incorporated herein by reference. The present application is also related to co-pending U.S. patent application Ser. No. 10/990,148, filed Nov. 15, 2004.

FIELD OF THE INVENTION

The present invention relates to adjustable snow plows for attachment to land vehicles, primarily personal utility vehicles such as pickup trucks and sport utility vehicles.

BACKGROUND OF THE INVENTION

Moving snow off of open ground, streets, sidewalks and parking lots is an age-old problem in less temperate climates where significant snowfall is anticipated during colder periods of the year. For instance, in many parts of Canada and in many northern states in the United States, significant snowfall can be expected during the late fall and early-to-mid winter months, and again in the late winter and even, at times, early spring.

Clearing freshly fallen snow from open ground, parking lots, driveways, sidewalks and roadways, whether these surfaces are paved or not, is a task common to all of these areas that is generally required to make these surfaces safe and passable, both initially and over time if the snow begins to build up after multiple snowfalls. If the snow is allowed to accumulate over a period of weeks, the snow eventually makes the use of these surfaces for both pedestrian and vehicular travel difficult, if not treacherous. Therefore, many devices have been designed and manufactured to remove freshly fallen and accumulated snow from such surfaces.

Municipalities generally use large vehicles with enormous snow plows to clear paved roadways used by the public, and county and state government public works and transportation departments in these areas also generally have a fleet of these kinds of vehicles to clear snow from roadways and from large parking lots on county-owned or state-owned properties.

The purchase and use of such a vehicle by individuals, however, who have a need to move or remove accumulated snow in smaller areas, such as driveways and privately owned parking areas, is less feasible. First of all, the larger vehicles are expensive to purchase and maintain and are, in some cases, dedicated solely to the removal of accumulated snow. It will be appreciated that it would not be cost effective for an individual to purchase, house and maintain such a vehicle for just removing snow from driveways and smaller parking lots during a limited period of the year. Furthermore, these vehicles are difficult to operate and often require significant training or experience operating such vehicles.

For this reason, many inventors have designed and manufactured adjustable snow plows that can be attached to pickup trucks and other vehicles for a period of time during the year when snow removal is required. In this way, the vehicles can be used for other purposes during periods when snow removal is not required.

Many of the snow plows attached to these vehicles, however, are large and heavy and are not easily attached and removed from the vehicles. A number of snow plows have been invented that attempt to address these problems. For instance, Kowalczyk (U.S. Pat. No. 4,944,104) discloses a detachable snow plow assembly that is pivotally attached to a common passenger vehicle. In one embodiment of the invention, the snow plow includes rollers secured within channels attached to mounting uprights to allow the plow blade to ride up and down when the blade comes into contact with irregularities in the surface. The plow blade can also pivot forward along with the mounting uprights in certain embodiments when the vehicle is moving backward allowing the plow blade to pivot forward over the ground. In other disclosures, such as the snow plow assembly disclosed by Rosenberg (U.S. Pat. No. 5,136,795), a trip mechanism is disclosed which allows the lower part of the plow blade to pivot backward when the plow blade comes into contact with relatively immovable objects and the trip mechanism is actuated. Rosenberg also discloses a rubber scraper at the bottom of the plow blade which is secured between two metal plates and oriented at an angle rearward of a vertical orientation. Rubber scrapers are also disclosed on older snow plows, such as the snow plow mold board disclosed by C. H. Wagner (U.S. Pat. No. 3,477,149), which discloses a resilient scraping blade made of rubber. This is a common feature in many snow plows, allowing the rubber scraper to contact the ground and provide a somewhat more forgiving surface with which to contact the ground when the plow is used to remove accumulated snow, but the rubber scraper is generally accompanied by a metal backing.

Although each of these inventions has its own advantages, none of them are easy to attach to or remove from the vehicle. These snow plows also tend to be heavy and cumbersome, and at least somewhat unsightly if one is required, for practical reasons, to keep it attached to the vehicle 24/7 for a period of several months during the snow season.

The present invention provides a more cost effective and attractive snow plow for removing smaller amounts of accumulated snow from driveways and small-to-medium sized parking lots where one individual may wish to use his or her vehicle to remove snow during a relatively limited period of time, while still having use of the vehicle available for other purposes, not involving snow removal, when the snow plow must either be removed from the vehicle and/or placed in a suitable position for non-snow removing transit.

In addition, the prior art snow plows are generally so heavy that they will not ride up when they are on open ground, for instance, but will tear up the ground and remove grass and other plant things often just because of the sheer weight of the plow as it passes along the ground surface. Also, the prior art snow plows are often virtually impossible for a single person to handle, because of the weight associated with these plows; and plows that appear to be relatively light weight, such as the snow plow described by Knutson et al. (U.S. Pat. No. 6,240,658), generally have multiple attachment points and do not appear to be highly effective, durable or marketable.

The present invention provides solutions for these and other problems associated with the prior art devices for removing accumulated snow and methods used to accomplish the same.

SUMMARY OF THE INVENTION

The present invention provides a snow plow for attachment to a vehicle, the snow plow including a mounting apparatus having a mounting frame, the mounting frame including two interconnected mounting uprights. The snow plow further including a plow blade, the plow blade including retention apparatus constructed and arranged to disengageably secure the plow blade to the mounting uprights when the plow blade is in a working orientation for use to plow snow. The plow blade preferably includes a mold board, the mold board preferably being an aluminum extrusion. In preferred embodiments, the aluminum extrusion will preferably include at least one attachment channel, preferably a plurality of attachment channels, in which parts of the snow blade can be secured or anchored. Preferably, the snow plow is constructed and arranged to slidably secure the plow blade to the mounting uprights when the plow blade is in use. The plow blade preferably includes first and second attachment channels and the retention apparatus preferably includes at least one retention member anchored in at least one of the attachment channels, preferably in both of the first and second attachment channels. In certain preferred embodiments, the mounting apparatus further includes an elongated member constructed and arranged to place downward force upon the plow blade when the plow blade is disengageably secured to the mounting uprights during use and the elongated member is a resilient elongated member, preferably a shock cord. In certain embodiments, the self-adjusting snow plow is attached to a vehicle in such a manner to permit the snow plow to make position adjustments when, during use then the vehicle is in motion, a portion of the snow plow comes into contact with a mass of snow or other relatively immovable objects on the ground, upon which the vehicle travels when in motion. The self-adjusting snow plow preferably includes a mounting apparatus for attachment to the vehicle, and a plow blade. The mounting apparatus preferably includes first and second mounting uprights and the plow blade has first and second ends, a top, a bottom, retention apparatus, perhaps a retention member and a rubber scraper, preferably secured to the bottom of the plow blade. In certain embodiments, the retention apparatus will include first and second retention members. In these embodiments, the retention apparatus is generally constructed and arranged to at least partially encircle at least one of the respective mounting uprights when the plow blade is engaged with the mounting apparatus in a working orientation, such that the plow blade is in contact with the ground or objects on the ground. The retention apparatus will preferably include at least one, preferably two retention members. The respective retention members preferably slidably engage the respective mounting uprights when the plow blade is engaged with the mounting apparatus in a working orientation.

When the plow blade alternate and preferred embodiments of the present invention come into contact with a mass of snow or other objects on the grounds that are relatively immovable, the retention apparatus, preferably the respective retention members, can slide upward along the respective mounting uprights to enable the respective ends of the plow blade to slide upwardly relative to the mounting upright most proximate to that end of the plow blade. The retention apparatus or retention members, in preferred embodiments, permit the bottom of the plow blade to pivot away from the respective mounting uprights when the plow blade is engaged with the mounting apparatus in a working orientation and the vehicle is in motion in a direction rearward of the plow blade. In certain embodiments, the rubber scraper secured to the bottom of the plow blade is a resilient elastomeric member having a resting orientation in which the rubber scraper extends downwardly and away from the bottom of the plow blade at an angle which extends forward from a plane which extends along a main surface of the plow blade. In certain of these embodiments, the rubber scraper is preferably about an inch thick and extends away from the plow blade at least about three and one-half inches. In alternate embodiments having a single retention member, the retention member is alternatively constructed and arranged to either encircle or partially encircle both of the mounting uprights.

It is a primary objective of the present invention to provide a method of clearing accumulated snow from the surface of driveways, parking lots and other similar areas where snow removal is essential during the winter months.

It is an additional objective of the present invention to provide such an apparatus that can be easily mounted and removed from the front end of pickup trucks, sport utility vehicles and other commonly used personal transit type vehicles, and that the apparatus for mounting the plow blade provides flexibility for mounting the plow blade at different relative heights with respect to vehicles that may stand at different relative heights off of the ground.

It is a further objective of the present invention to provide such an apparatus for snow removal that is much simpler to install and use then other similar devices commonly found in the market today.

It is a further objective of the present invention to provide such an apparatus for snow removal which includes a plow blade which is relatively light and allows an individual person to lift respective ends of the plow blade in order to lower them into position for clearing snow or to lift the respective ends of the plow blade to secure the blade in position for transit, while still providing a durable plow made of materials strong enough to stand up to heavy use during the months in which snow plowing is required.

It is a further objective of the present invention to provide such an apparatus for snow removal that does not require the owner of the vehicle to purchase separate running lights for the vehicle in order to use the self-adjusting snow plow.

It is yet another objective of the present invention to provide such an apparatus for snow removal that easily slides upward on a mounting apparatus to allow the plow blade to go up and over immovable objects encountered during use.

It is a further objective to provide a plow blade that is essentially hinged to the mounting apparatus to permit rapid retreat for the convenience of the user.

It is yet another objective of the present invention to provide such an apparatus for snow removal that allows the operator to drive in reverse after moving snow off of a flat surface, wherein the plow blade is hinged so that the blade "floats" freely on a pair of mounting uprights and can slide up and down independently on the mounting uprights and the lower portion of the plow blade can pivot forward with respect to the mounting uprights allowing the vehicle to easily draw the plow blade in reverse.

It is yet another objective of the present invention to provide such an apparatus for snow removal that lifts the rubber scraper at the bottom of the plow blade off the ground when the vehicle draws the plow blade in reverse and the lower portion of the plow blade pivots forward with respect to the mounting apparatus.

It is still a further objective of the present invention to provide such a method that does not employ the use of expensive and heavy hydraulic systems that are common used in such devices today.

Although other vehicle accessory connection devices can be used, these objectives are preferably accomplished by the use of a common hitch receiver that is attached to (and extends forward from) the front end of the vehicle that is to be used in the plowing operation. This receiver hitch preferably provides a mounting point for the mounting apparatus, which is preferably accomplished by inserting a tongue of the plow hitch into the hitch receiver and then locking it into place with a pin. This forms a solid mounting for the present invention that allows it to be quickly and easily attached to the front end of any vehicle. A primary advantage of this invention is that it does not require that a user keep the plow assembly on the plow vehicle for the entire season. Its ease of use is also a primary advantage as is its moderate cost.

It is a further objective of the present invention to provide a system for placing downward force on the plow blade when the plow blade is in use, preferably a resilient elongated apparatus for placing downward force on the plow blade as a substitute for constructing the plow blade out of heavy materials which would be difficult for an individual to lift.

It is yet another objective of the present invention to provide a method of placing downward force upon the plow blade during snow plowing operations, preferably a method of providing an elongated member, preferably a resilient elongated member, interconnected between the mounting apparatus and the plow blade such that the elongated member places a sufficient amount of downward force on the plow blade during snow plow operations to improve the usefulness of the plow blade in removing snow during such operations, particularly when the plow blade comes into contact with heavy snows that might otherwise begin to cause the plow blade to ride up on the respective mounting uprights.

It is yet another objective of the present invention to provide an interconnection system for interconnecting the mounting apparatus of the present snow plow to a vehicle that includes a simple swivel apparatus that can pivot to permit the plow blade to be turned either to the left or to the right of an angle generally perpendicular to the direction of travel of that of the vehicle pushing the plow blade.

It is still another objective of the present invention to provide a mounting apparatus including two mounting uprights, the mounting uprights preferably including attachment members for securing the plow blade when the plow blade is not in use for snow plowing operations and the vehicle is used for transit purposes. It is a further object to provide attachment members that allow the plow blade to be easily lifted, one end at a time, and secured in the respective attachments members one end at a time, so that a single individual can easily lift the plow blade up into the non-operational use position without assistance.

It is yet another objective of the present invention to provide a plow blade including a mold board having attachment channels in which functional parts of the plow blade may be anchored or secured, preferably by securing anchoring nuts within the attachment channel, or attachment channels, in which to secure reciprocally threaded bolts that anchor or secure the functional parts of the plow blade within the attachment channel or channel, such as retention apparatus, preferably a retention member or retention members, a handle or handles for lifting the plow blade and/or hook apparatus, such as a hook or hooks for interconnecting the plow blade to a resilient elongated member attached to the mounting apparatus to provide a downward force on the plow blade during use for snow plowing operations.

These and other objectives and advantages of the invention will appear more fully from the following description, made in conjunction with the accompanying drawings wherein like reference characters refer to the same or similar parts throughout the several views. And, although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

BRIEF DESCRIPTION OF THE DRAWINGS

In the drawings, in which corresponding reference numerals and letters indicate corresponding parts of the various embodiments throughout the several views, and in which the various embodiments generally differ only in the manner described and/or shown, but otherwise include corresponding parts;

FIG. 13 is a further partial side elevation of an alternate plow blade 30''' showing a further alternate rubber scraper 36''';

FIG. 23 is a front elevation of an alternate self-adjusting snow plow 110'''; similar to that shown in FIGS. 4 and 22 where the plow blade 130''' is shown in a working orientation and is shown in phantom in further working orientations when one end or the other is raised with respect to the mounting uprights 120''', but the plow blade 130''' includes an alternate retention member 238', which just partially encircles each of the mounting uprights 120''';

FIG. 30 is a side elevational view, similar to that shown in FIG. 27, but showing the alternate mounting upright 320' and attachment member 351' shown in FIG. 29, and showing the securing pin 383 in the receiving slot 385*a'*, with additional retention members 338 shown in phantom to demonstrate how the securing pin 383 can limit the upward movement of the retention member 338 along the mounting upright when the retention member 338 is slideably secured on the mounting upright 320' and is not within the attachment member 351';

FIG. 31 is a front elevational view taken from line 31—31 of FIG. 30, showing a cross-section of the securing pin 383 and showing the pin 383 in place in the receiving slot 385*a'* as shown in FIG. 30, and showing the handle 383*b* of the securing pin 383 in hidden line, behind the upper portion of the mounting upright 320', pointing in a downward, resting position;

FIG. 32 is a view similar to that shown in FIG. 31, but showing the handle 383*b* of the securing pin 383 in an upright position, or orientation, in which it must reside in order to be effectively inserted or removed from the pin receiving slot 385*a'* of the alternate attachment member in the upper portion of the alternate mounting upright;

FIG. 33 is a perspective view of an optional angle interceptor 311 including a pivoting swivel mechanism in the vehicle connection member 323 of the alternate mounting apparatus 314 shown in FIG. 24;

FIG. 38 is a diagrammatic view of the alternate mounting frame 309 shown in FIG. 24 as seen from the front of the vehicle (not shown) to which the mounting apparatus 314 preferably would be secured, when the mounting frame 309 is in a perpendicular orientation as shown in FIG. 35, and showing the plow blade 320 in a raised position, and the preferred resilient elongated member 391 attached only to the mounting frame 309 and showing the plow blade 320 in a working or an operation orientation in phantom;

FIG. 39 is a diagrammatic view similar to that shown in FIG. 38, except that the plow blade 320 is in a lowered working orientation, wherein the retention members 338 are disengageably secured to the mounting uprights 320 for snow plowing operations; and the resilient elongated member 391 is interconnected between the mounting frame and the plow blade 330 creating downward force of the plow blade 330;

DETAILED DESCRIPTION OF THE PREFERRED EMBODIMENTS

Figure 1:
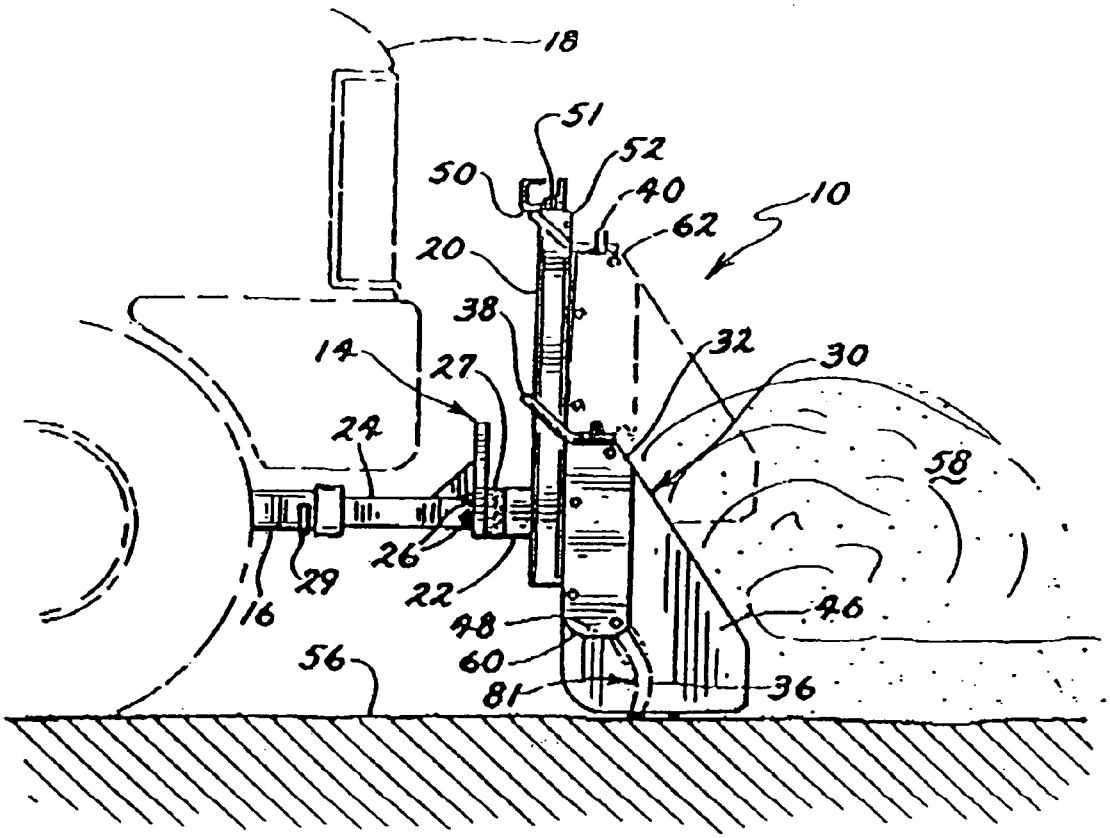
FIG. 1 is a side elevation of an embodiment of the present invention showing a self-adjusting snow plow 10, with the plow blade 30 in a working or operational orientation, attached to a vehicle 18 (shown in phantom): The plow blade 30 is also shown in phantom in an elevated position, where the plow blade 30 is in a non-working, transit orientation.
Figure 2:
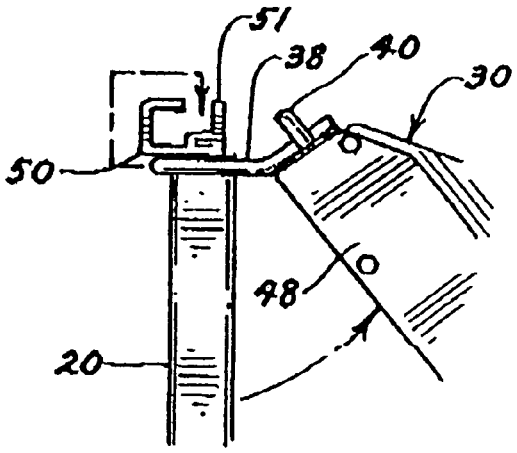
FIG. 2 is a partial side elevation of the self-adjusting snow plow 10 shown in FIG. 1 showing the plow blade 30 in a position in which the bottom (not shown) of the plow blade 30 is pivoted forward so that a retention member 38, secured to the mold board 32 of the plow blade 30, can be disengaged from the mounting upright 20 and placed in the attachment member 51 so that the plow blade 30 can reside in the non-working transit orientation shown in FIG. 3.
Figure 3:
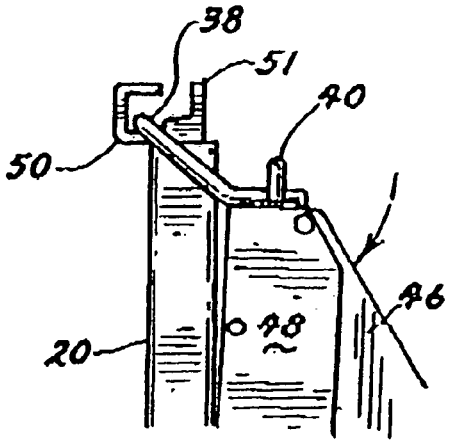
FIG. 3 is a partial side elevation of the self-adjusting snow plow 10 shown in FIGS. 1 and 2, but showing the plow blade 30 in the non-working, transit orientation.

Referring now to the drawings, and more particularly, to FIGS. 1–3, an alternate embodiment of a self-adjusting snow plow 10 of the present invention is shown. The preferred snow plow 10 includes a mounting apparatus 14 and a plow blade 30. The mounting apparatus 14 includes two mounting uprights 20 that are interconnected by an interconnecting member 22. In this embodiment, a hitch tongue 24 is secured to the interconnecting member 22. The hitch tongue 24 is secured to the interconnecting member 22 with a resilient rubber connecting member 27 interspersed between the interconnecting member 22 and a flat connecting plate 28 of the hitch tongue 24. A hitch tongue securing pin 29 secures the hitch tongue 24 in a hitch receiver 16, which is secured to a vehicle 18 (partially shown in phantom in FIG. 1). The resilient rubber connecting member 27 allows the entire snow plow 10 some flexibility when the plow blade 30 is subjected to great forces. This is believed to reduce the shock and vibration in the vehicle 18 due to impacts against relatively immovable objects. The connecting plate 28 is bolted to the interconnecting member 22 by a series of fasteners, preferably bolts 25 secured by nuts 26.

Figure 7:
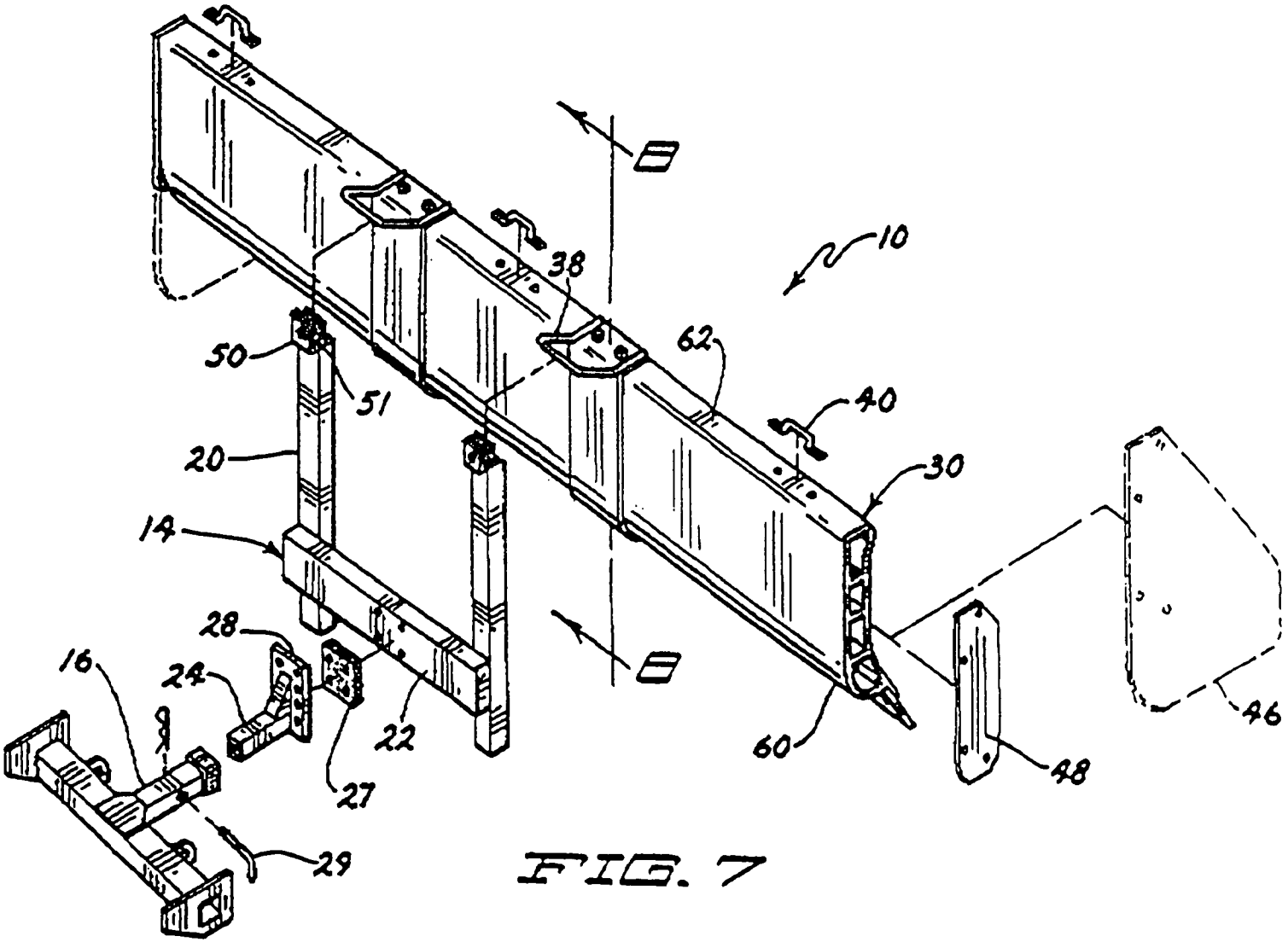
FIG. 7 is an exploded perspective view of the self-adjusting snow plow 10 shown in FIGS. 1–3.
Figure 8:
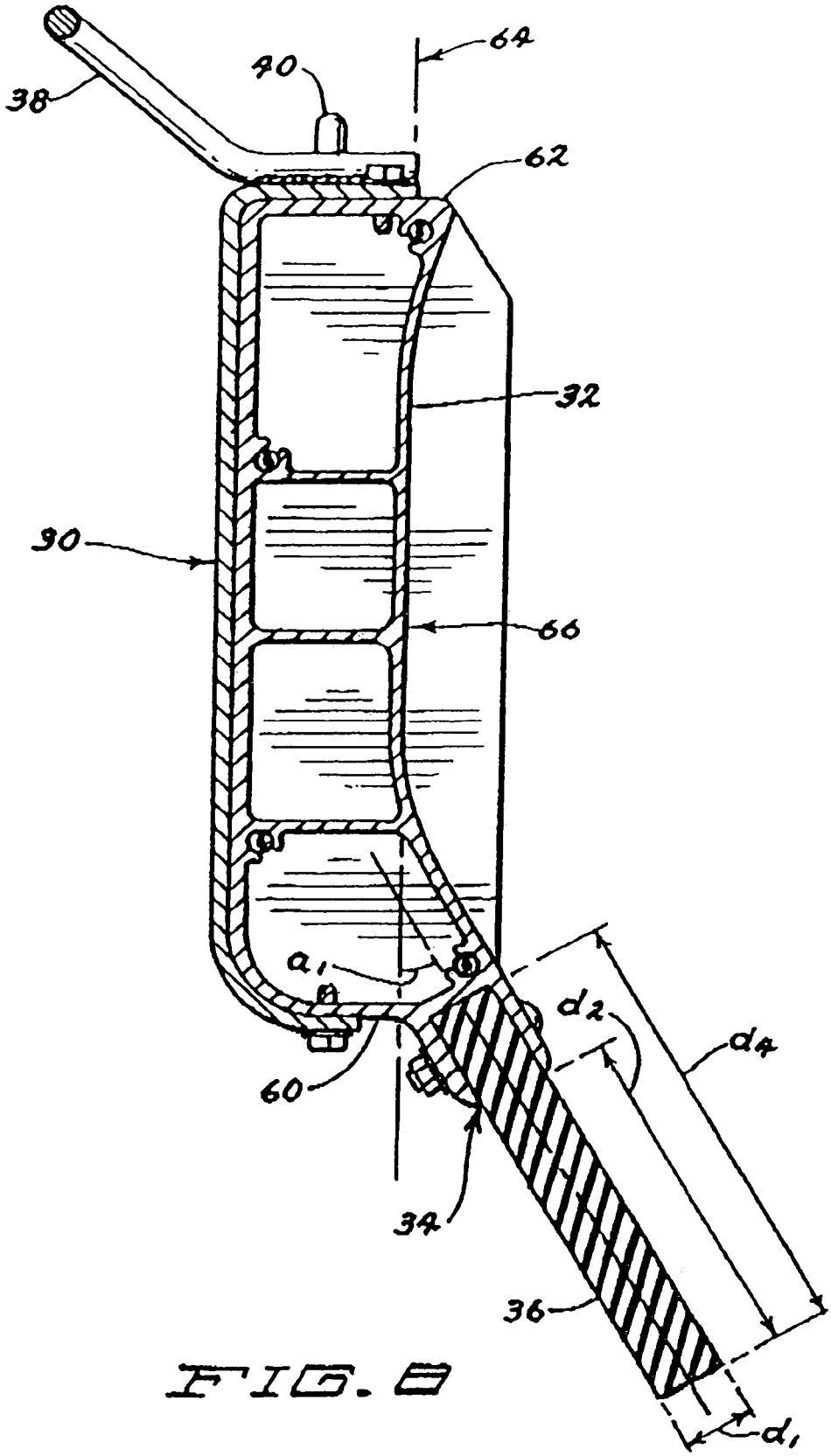
FIG. 8 is a cross-sectional view of the plow blade 30 shown in FIG. 7 as seen from the line 8—8 of FIG. 7.
Figure 11:
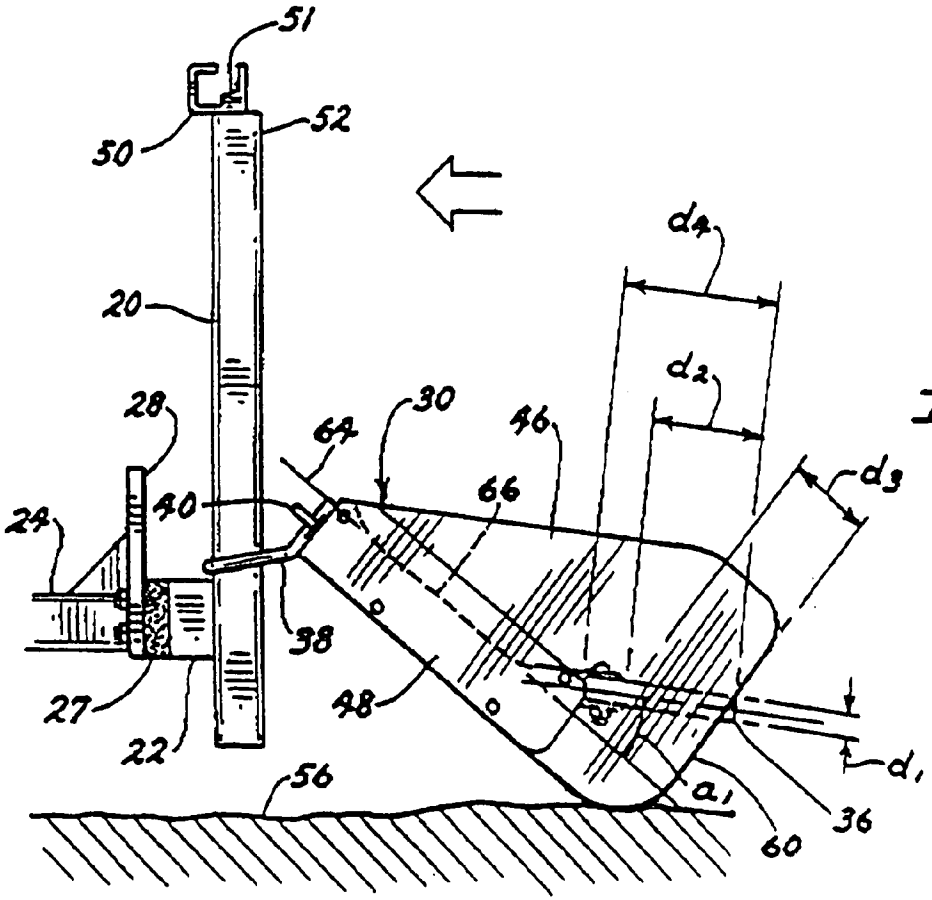
FIG. 11 is a side elevation similar to that shown in FIG. 10, but showing the plow blade 30 shown in FIGS. 1–3 when the vehicle (not shown) moves backward drawing the preferred plow blade 30 with it in a manner which allows the bottom of the plow blade 30 to pivot forward, away from the mounting uprights 20.

Referring now also to FIGS. 7–8 and 11, the preferred plow blade 30 includes a mold board 32 providing a rubber scraper channel 34 in which a rubber scraper 36 is secured. The preferred mold board 32 is a single piece aluminum extrusion, although other materials may be used. The plow blade 30 also includes two retention members 38 and a plurality of lifting handles 40. The preferred plow blade 30 has enlarged end caps 46 secured at each end of the plow blade 30 with blade cap securing plates 48. In preferred embodiments, the end caps 46 and the rubber scraper 36 are made of resilient elastomeric materials such as hardened natural rubbers and other synthetic materials, which have been used commercially to replace such products. In preferred embodiments, this material can be Styrene-Butadiene Rubbers (SBR), butylene rubbers (copolymers of isobutylene and isoprene), Acrylonitrile-Butadiene rubbers (NBR), initial neoprene, Thiokol® rubbers and the like; preferably SBR. In the most preferred embodiments SBR 60 Durometer rubber is used. It will be appreciated that the term "rubber", when used to describe the various embodiments of the scraper 36 or the end cap 46, is used in a general sense and is not meant to limit the material used to construct the scraper 36 or the end cap 46 solely to rubber, but that it will also mean the aforementioned elastomers and other like materials.

Referring now also to FIGS. 4–5 and 9–10, a further alternate embodiment of the plow blade 30' is shown in which the end caps 46' are metal sheets the size of and similar to the blade cap securing plates 48 of the embodiment shown in FIGS. 1–3 and 7–8. These end caps 46' do not extend beyond a bottom 60' of the mold board 32'. It will be appreciated that the embodiment shown in FIGS. 1–3, 7 and 11 can be modified by removing the end caps 46 and simply replacing them with the end cap securing plates 48, which take the place of and become the replacements for the end caps 46, as used in the alternate embodiments shown in FIGS. 4–5 and 9–10. With the exception of the respective different end caps 46 and 46', everything else about these embodiments is generally the same.

Figure 6:
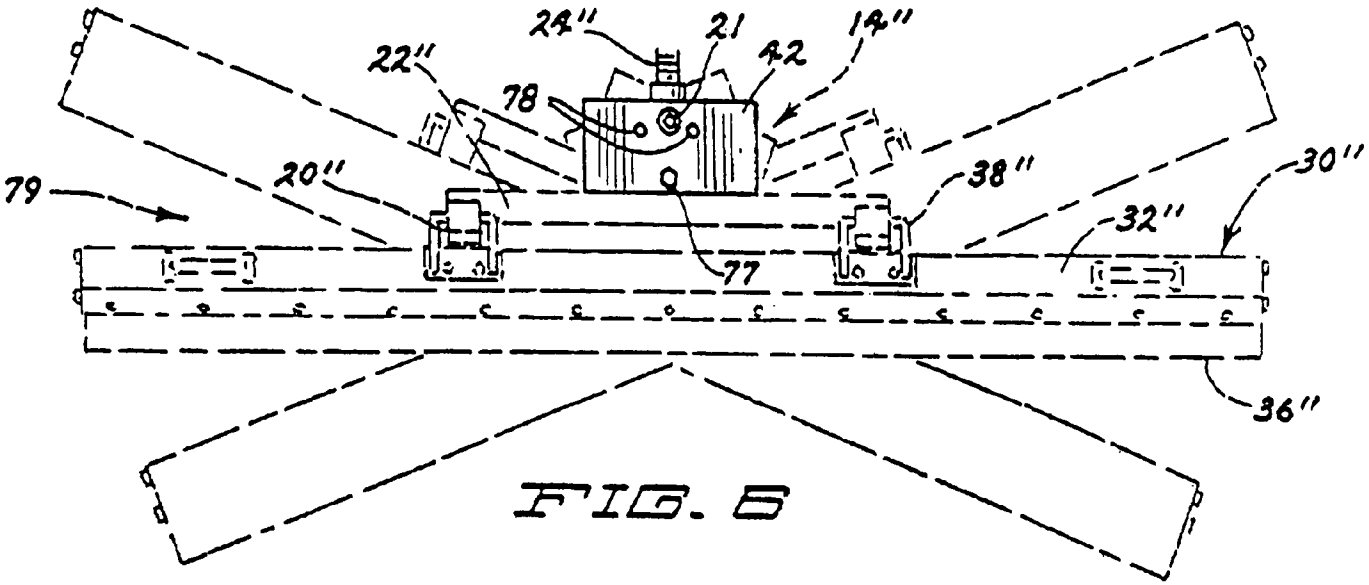
FIG. 6 is a top elevation of a further alternate embodiment of the self-adjusting snow plow of the present invention showing a plow blade 30" in phantom which is the same as that shown in FIG. 5, but showing an alternate mounting apparatus 14" having a pivotal hitch assembly 42 which can be secured to place the plow blade 30" at an angle to a plane perpendicular to a line parallel to a forward direction of the vehicle (not shown)

Referring now also to FIG. 6, a further alternate mounting apparatus 14" is shown in which the mounting uprights 20" are secured to an interconnecting member 22" which is joined to a pair of generally identical plates 42, only one of which is shown, which sandwich and are pivotally connected with an alternate hitch tongue 24" by a pivot pin 77. A removable lock pin 21 is used to secure the plates 42 in one position or another (as shown in phantom) by removing the lock pin 21 and turning the blade 30" so that aligned holes 78 (shown only in the upper plate shown in FIG. 6) in the respective plates 42 align with a hole in (not shown) the hitch tongue 24" after the mounting uprights 20" and the plow blade 30" are turned sufficiently to allow the respective aligned lock pin receiving holes in the respective plates 42 and the hole in the hitch tongue 24" to be aligned.

The plow blade 30' of the second embodiment shown in FIGS. 4–5 and 9–10 has been found to be somewhat more effective than the first embodiment of the plow blade 30 (shown in FIGS. 1–3, 7 and 11), when the plow is pivoted in either direction to push snow to one side or the other of the vehicle 18, because the larger end caps 46 of the first embodiment are not used. This makes it easier for snow to slide off of one end of the plow blade 30', 30" or the other when the plow blade is being pushed forward. It is possible to address this potential enhancement by simply removing the end cap 46 from one end of the preferred plow blade 30, when it is used with the alternate mounting apparatus 14", in which case the end cap 46 at the end which is tilted backwards will be the one which is removed and replaced by the end cap securing plate 48 to permit snow to easily slough off of or away from that end of the plow blade 30, rather than collect lots of snow, which may make plowing operations more difficult.

In FIG. 1, the preferred plow blade 30 is shown in a working orientation in which the retention members 38 encircle the respective mounting uprights 20. As the snow plow 10 is pushed forward and force is applied to the plow blade 30 and the rubber scraper 36, the rubber scraper has a tendency to bend backward at its lowest extremities, most removed from the mold board 32. In this way, the force on the lower part of the rubber scraper 36 can have a lifting effect on the plow blade 30, forcing the retention member 38 to slide upward along the mounting uprights 20, in certain cases, until the retention member 38 strikes a catch structure 50 at an upper end 52 of the mounting uprights 20 as shown in phantom in FIG. 1. In alternate embodiments shown elsewhere (see FIGS. 14, 26–28 and 29–30), the catch structure 50 is not provided to limit the upward movement of the retention member 38, but a retention pin (80 in FIG. 14 and 82 in FIGS. 26–28 and 29–30) will limit the upward movement of the retention members 38, so long as these pins are engaged in the respective attachment members 51, 351 and 351'.

Figure 4:
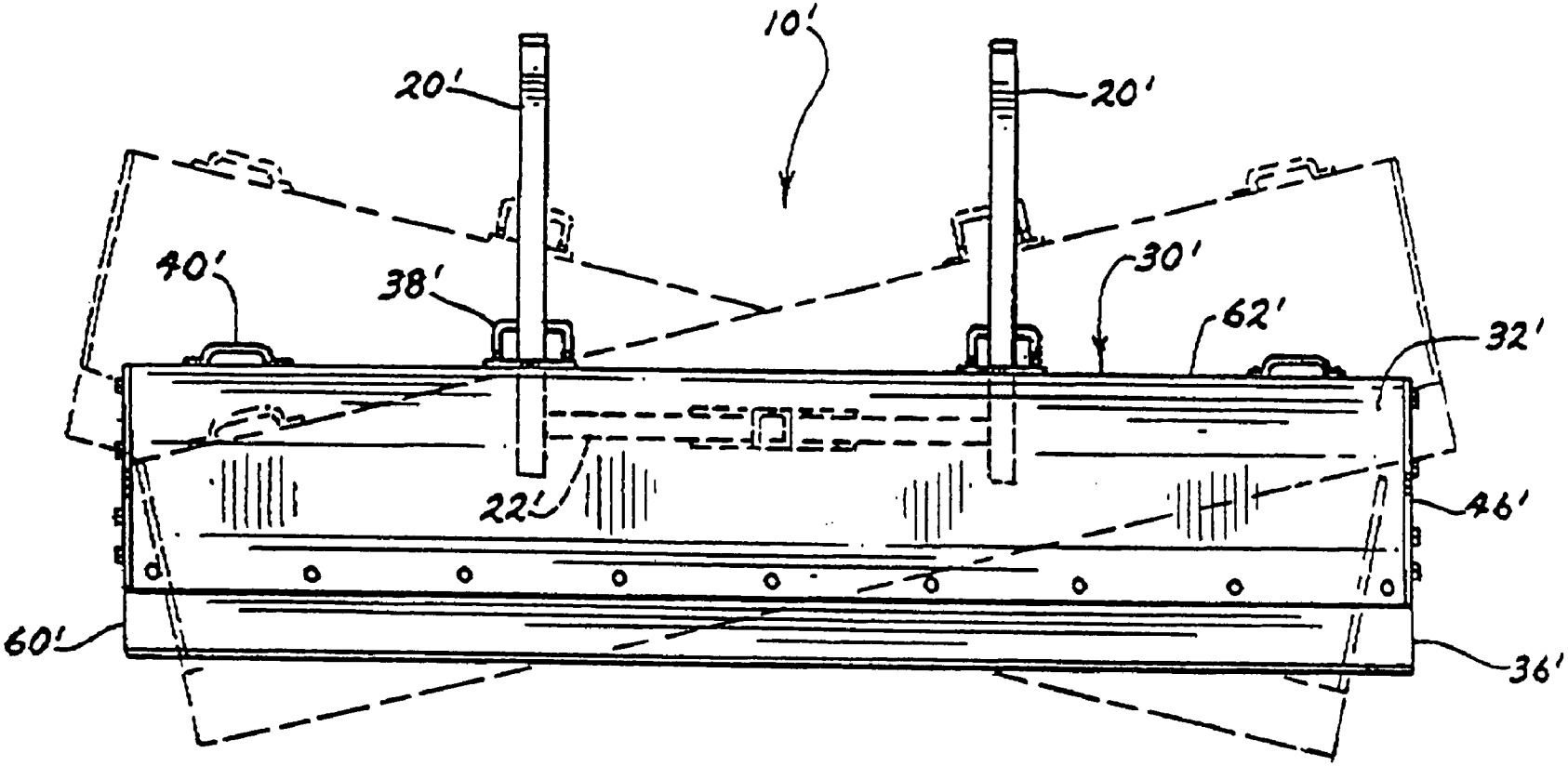
FIG. 4 is a front elevation of an alternate self-adjusting snow plow 10'; the plow blade 30' is shown in a working orientation and is shown in phantom in further working orientations when one end or the other is raised with respect to the mounting uprights 20'.
Figure 5:
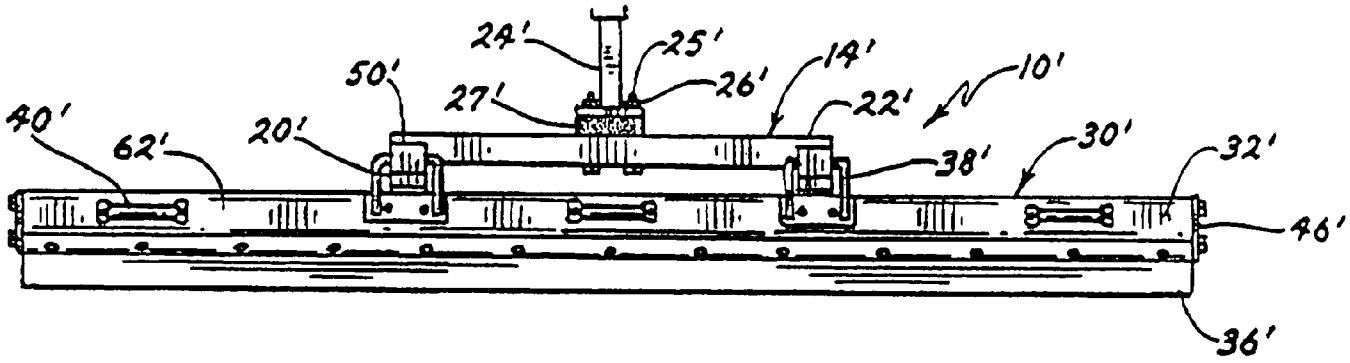
FIG. 5 is a top elevation of the self-adjusting snow plow 10' shown in FIG. 4.
Figure 9:
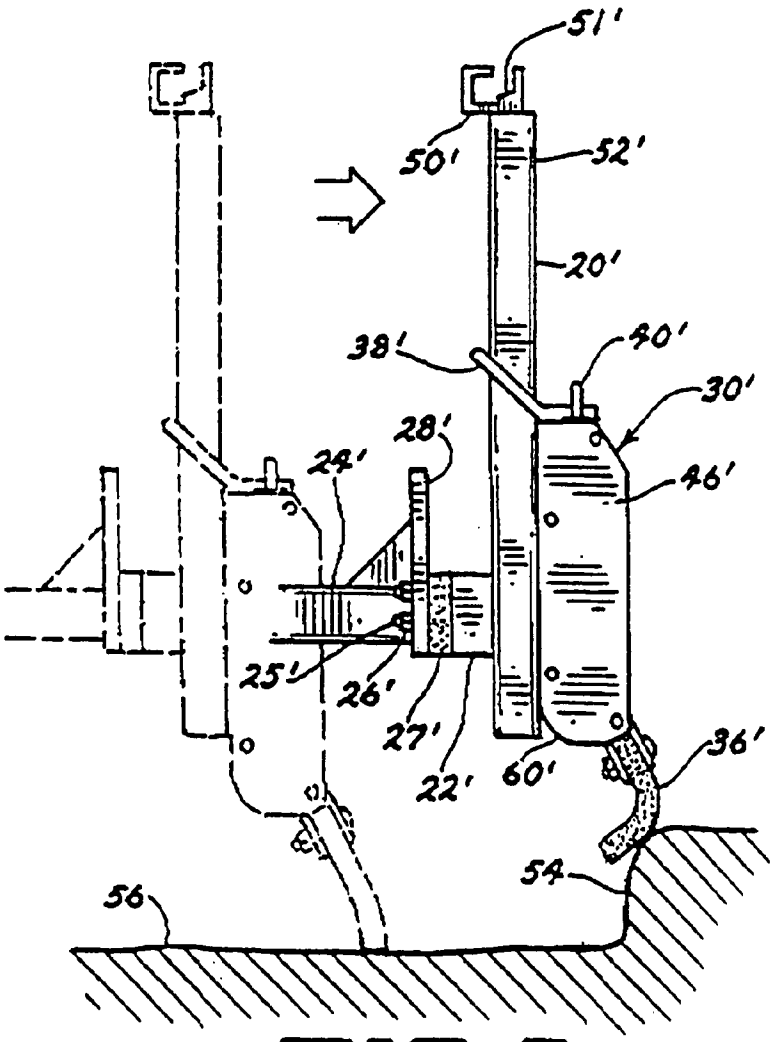
FIG. 9 is a side elevation of the alternate self-adjusting snow plow 10' shown in FIGS. 4 and 5 illustrating how the plow blade 30' slides upwardly with respect to the mounting uprights 20' when it moves forward and comes into contact with a relatively immovable object on the ground 56, wherein the drawing illustrates in phantom the plow blade 30' in a working orientation as it is moving forward toward such a relatively immovable object and also showing the plow blade once it has moved upward with respect to the mounting uprights 20' after the rubber scraper 36' has come into contact with such a relatively immovable object.

Referring now also to FIG. 9, which shows the alternate embodiment shown in FIGS. 4 and 5, it is noted that the retention member 38 will also slide upward when the rubber scraper 36' comes into contact with a relatively immovable object 54 along the ground 56 such as a curb or the like. As shown in FIG. 1, the rubber scraper 36 will also bend backwards at the lower extremities when it is pushing a mass of accumulated snow 58.

Figure 10:
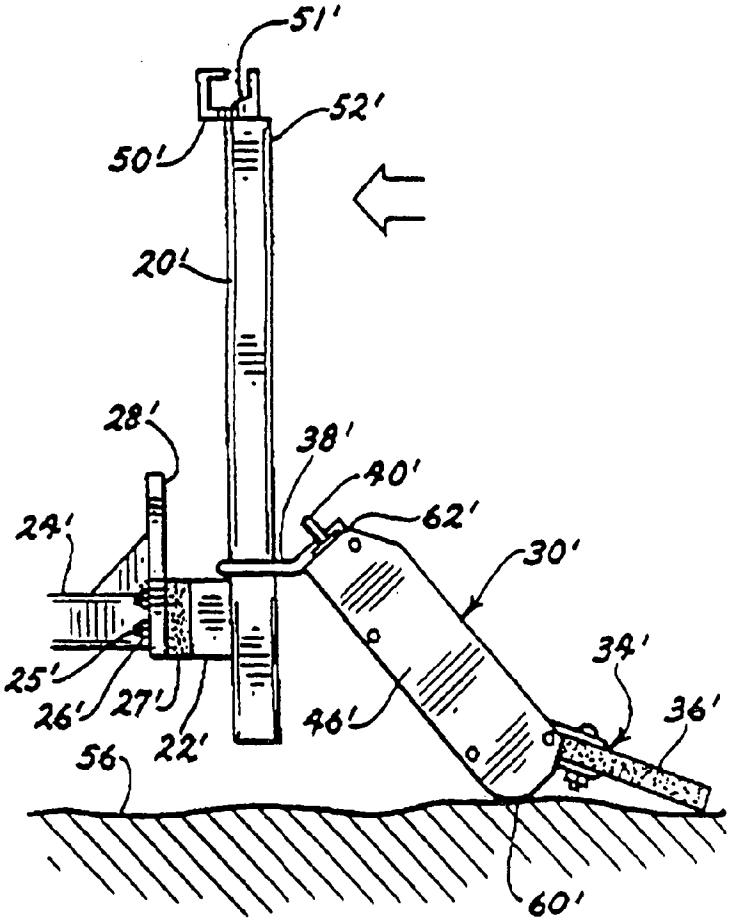
FIG. 10 is a side elevation of the alternate embodiment of the self-adjusting snow plow 10' shown in FIGS. 4–5 and 9 showing how the bottom of the plow blade 30' pivots outward away from the mounting uprights 20' when the vehicle (not shown), to which the self-adjusting snow plow 10' is attached, moves backward drawing the plow blade 30' with the vehicle.

Referring now also to FIG. 10, when the vehicle 18 (not shown) is placed in reverse and the plow blade 30' is drawn backwards, the bottom 60' of the plow blade 30' will naturally pivot away from the mounting uprights 20' because the plow blade 30' is only secured at the top 62' by the retention members 38' which acts in essence, as slideably hinges upon which the plow blades 30, 30' (etc.) of the present invention can pivot to a limit degree in such circumstance.

Referring now also to FIGS. 8 and 11, in which the first embodiments of the adjustable snow plow 10 and the plow blade 30 are shown, when this embodiment of the plow blade 30 is drawn backwards, when the vehicle 18 (not shown) goes in reverse, the rubber scraper 36 is raised above the ground 56 because the end caps 46 extend well beyond the bottom of the mold board 32 and the rubber scraper channel 34 provided by the mold board 32 for the rubber scraper 36; This permits snow and gravel and debris to pass below the rubber scraper 36 when the plow blade 30 is drawn backwards. This is advantageous in certain situations in which there is a desire not to draw snow backwards with the plow blade 30. When using other devices, it is also necessary to lift the plow blade 30 so as to not draw snow 58 backwards when taking the vehicle in reverse. In this case, however, the extension to the plow blade 30 provided by the end caps 46 raises the bottom of the mold board 32 and the rubber scraper 36, which extends away from the mold board 32 at an angle. Referring now also to FIG. 8, this angle, angle al, relative to a plane 64 of the main surface 66 (shown in phantom in FIG. 11) of the plow blade 30 is at least about 10°, preferably at least about 20°, more preferably at least about 25°, even more preferably at least about 30°, even more preferably at least about 32° and most preferably at least about 32.5°. In preferred embodiments, the end caps 46 extend below the mold board 32 a distance $d_3$. In preferred embodiments, this distance is at least about two inches, preferably at least about 2.5 inches, more preferably at least about three inches, and most preferably at least about 3.5 inches, and even more preferably at least about four inches.

In preferred embodiments, the rubber scraper 36, 36' is skirtboard rubber which has a thickness, $d_1$, in a range from about 0.5 to about two inches, preferably about 0.625 to about 1.75 inches and more preferably from about 0.75 inches to about 1.5 inches. In the most preferred embodiments, the thickness of the rubber scraper 36, 36' is about one inch and it is made of SBR rubber having a hardness of about 60, although it may be more or less than 60 depending on the nature of the climate of the environment in which it will be used and other considerations, including wear resistance, speed of use and the like. The length of the rubber scraper 36, 36', designated by line $d_4$, is preferably in a range from about four to about ten inches, more preferably from about five to about nine inches, even more preferably from about six to about eight inches. In the most preferred embodiments, the length of the rubber scraper 36, 36' will be about six and one-half inches. In preferred embodiments, the length, $d_2$, of the amount of the rubber scraper 36, 36' which extends beyond the end of the scraper channel 34 of the mold board 32, 32' is preferably from about three to about seven inches, more preferably from about four to about six inches, most preferably about five inches. In preferred embodiments, the length of the rubber scraper 36, 36' which extends beyond the end of the scraper channel 34 of the mold board 32, 32' is at least about two and one-half inches, preferably at least about three inches, more preferably, at least about three and one-half inches, even more preferably at least about four inches, and even more preferably, at least about four and one-half inches, most preferably at least about five inches.

Figure 12:
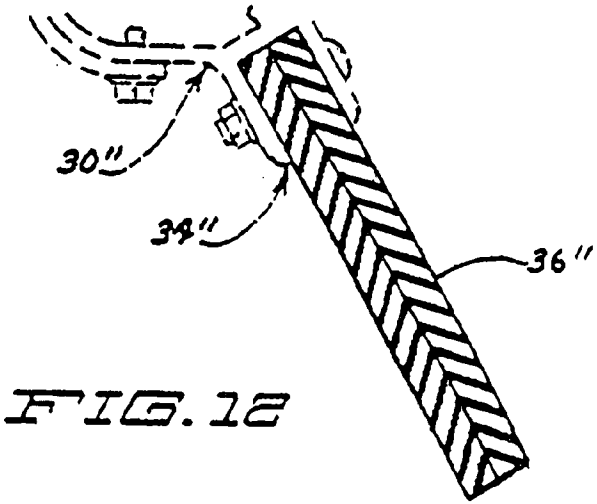
FIG. 12 is a partial side elevation of an alternate plow blade 30" having an alternate rubber scraper 36"
Figure 10:
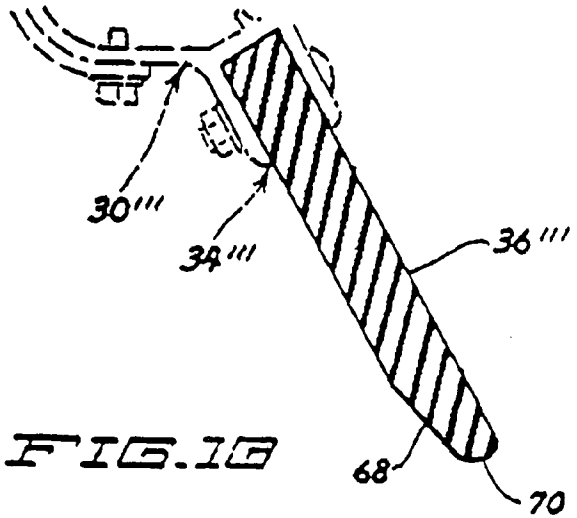

Referring now also to FIG. 12, a further embodiment of the rubber scraper 36" is shown. In this embodiment, the rubber scraper 36" is made up of two separate sheets of skirtboard rubber that are secured together side by side within the scraper channel 34" of the mold board 32".

Referring now also to FIG. 13, a further alternate embodiment of the rubber scraper 36''' is shown in which the backside of the rubber scraper 36''' includes a slight bevel 68 or chamfer at the lower end 70 of the rubber scraper 36'''.

Referring now again specifically to the first embodiments shown in FIGS. 2 and 3, the plow blade 30 may be moved from a working orientation, similar to that shown in FIG. 1, to a non-working transit orientation or position shown in FIG. 3 by raising one end of the plow blade 30 to the upper end 52 of the mounting upright 20, swinging the bottom 60 of the plow blade 30 outward and away from the mounting upright 20 to permit the retention member 38 to slide back past and over the catch structure 50, and then down into the attachment member 51 where it can be retained as shown in FIG. 3. After this has been done at one end, the same process can be followed to lift the retention member 38 of the opposite end of the plow blade 30 off of the mounting upright 20 so that the retention member 38 can be placed in the attachment member 51 in a manner similar to that shown in FIG. 3. Once both retention members 38 are retained within the respective attachment members 51 at the upper ends 52 of each of the mounting uprights 20, the plow blade 30 will be in a non-working, transit orientation in which the plow blade 30 is not in contact with the ground 56 and the vehicle 18 may be used for purposes other than moving accumulated snow 58 or other materials. Because of the light weight of the plow blade 30, the plow blade 30 can be easily placed in the non-working, transit orientation by a single individual.

It is just as easy for a single individual to lower the plow blade 30 into a working or operational orientation when it is in a non-working transit orientation. To lower the plow blade 30 into a working orientation, the individual can lift a retention member 38 out of the attachment member 51 at one end, swing the bottom 60 of the plow blade 30 outward so as to generally pivot it away from the mounting upright 20, then lower the retention member 38 over the upper end 52 of the mounting upright 20 and allow the retention member to slide down the mounting upright 20 until the lower extremity of that end of the plow blade 30 comes into contact with the ground 56. Once the first end is in contact with the ground, the user can lift the opposite end in a similar manner, swinging the bottom 60 of the plow blade 30 outwardly so as to pivot the bottom 60 of the plow blade 30 away from the mounting upright 20, so that the remaining retention member 38 can be first of all disengaged from the attachment member 51 and then lowered over the upper end 52 of the mounting upright 20 until the lower extremity of the remaining end of the plow blade 30 comes into contact with the ground 56. At this point, the plow blade 30 will be in a working orientation in which it may be pushed by the mounting apparatus to gather and remove snow or other particulate matter on the surface of the ground 56. In alternate embodiments of the present invention shown in FIGS. 14, 26–28 and 29–30, if the retention pins 80, 83 are removed from the respective attachment members 51'''', 351 and 351', it is believed to be especially easy to place the respective retention members in the respective attachment members or remove the respective retention members from the respective attachment members, because once the retention pins 80, 83 are removed, and since there is no catch member 50, it is a simple matter to just lift each of the respective ends of the plow blade up and either place them in the respective attachment members or remove them from the respective attachment members and, in the second case, lower that end to the ground. This is especially easy for a single person to accomplish without help from others.

When the plow blade 30 is lowered into the working orientation, it operates simply when the vehicle moves forward and the mounting uprights 20 push the plow blade 30 forward in a manner which will generally cause the resilient rubber scraper 36 to bend at its lowest extremities in the manner shown in FIG. 1. When the alternate mounting apparatus 14" is used to tilt one end of the plow blade 30" back, the mounting uprights 20" still push the blade 30" and the retention members 38" hold the blade 30" in place in front of the mounting apparatus 14".

Referring now especially to FIG. 4, occasionally, the plow blade 30' will encounter greater resistance either to a mass of snow or other relatively immovable objects on one side or the other, causing one end of the plow blade 30' or the other end of the plow blade 30' to ride up on the mounting upright 20' most proximate that particular end of the plow blade 30', as shown in phantom in FIG. 4. Because the preferred retention members 38' have openings 75 which are significantly larger than the mounting uprights 20', the plow blade 30' can ride up on one end or the other until retention member 38' is stopped by the stop structure 50 at the upper end of the respective mounting upright 22' or by a retention pin 80, 83 in other embodiments (See FIGS. 14, 26–28 and 29–30).

It will be appreciated that the retention members 38, 38' are designed and constructed to provide an opening 75 which is large enough to allow a person to lift one end of the plow blade 30, 30' up and disengage the retention member 38, 38' from the respective mounting upright 20, 20' with which it is engaged when it is in a working orientation. At the same time, however, the opening 75 has been designed and constructed to disengageably secure the mold board 32, 32' of the plow blade 30, 30' is a manner which will not allow the retention member 38, 38' to slide all the way to the upper end 52, 52' of the mounting upright 20, 20' without eventually striking the stop structure 50 or a retention pin 80, 83 in other embodiments (See FIGS. 14, 26–28 and 29–30), which will prevent the plow blade 30, 30', 130 from disengaging from the mounting uprights 20, 20', 120, 120'.

Figure 14:
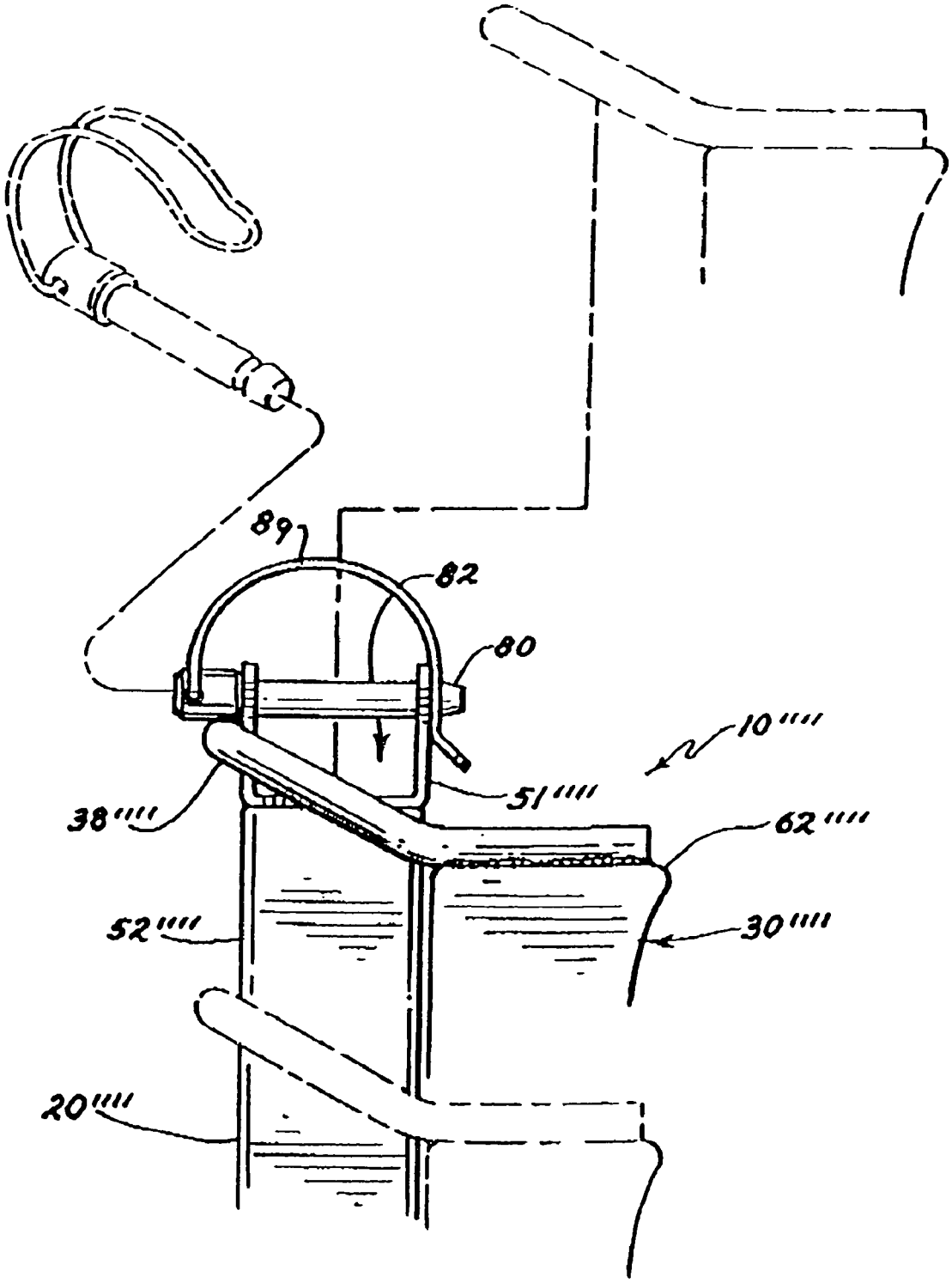
FIG. 14 is a side elevation of a portion of a further alternate embodiment of the present self-adjusting snow plow 10'''' showing an alternate catch structure at the upper end of the mounting upright 20'''' which also includes an alternate attachment member including a removable pin 80 with which to secure the retention member 38'''' within the attachment member 51''''.

Referring now also to FIG. 14, which shows a further alternate embodiment of the snow plow 10"" in which, the retention members 38"" are stopped by a retention pin 80 which is secured within an alternate attachment member 51"". In this embodiment, the retention pin 80 must be removed in order to lift the retention member 38"" off of the upright 20"" and place the retention member 38"" within the attachment member 51"". Once the retention member 38"" is placed within the receiving opening 82 of the attachment member 51, the retention pin 80 can be secured within openings (not shown) in the respective sides of the attachment member 51"" and a bale or spring wire 89 can be secured over an end of the pin 80 to secure the pin 80. Although not shown, a spring loaded ball bearing pin (not shown) can also be used in such an attachment member 51"". In this embodiment, the function of the retaining pin 80 makes the need for a catch, such as catch 50 shown in FIGS. 1–3, essentially unneeded so long as the retention pin 80 is in place when the snow plow 10"" is in use.

Figure 15:
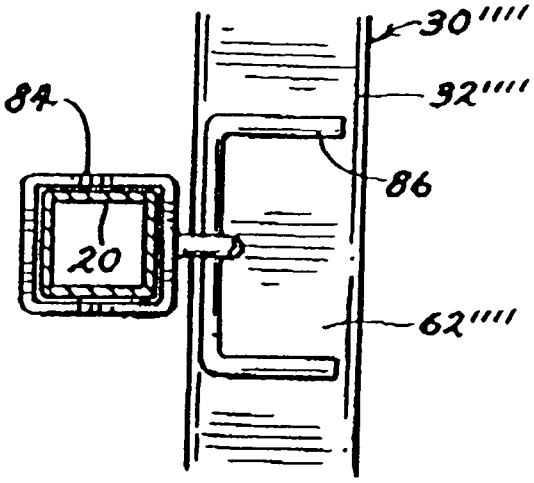
FIGS. 15 and 16 are top plan views of alternate retention members 84, 84.
Figure 16:
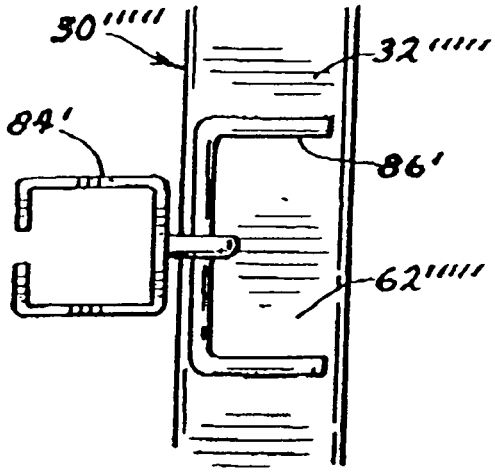
Figure 17:
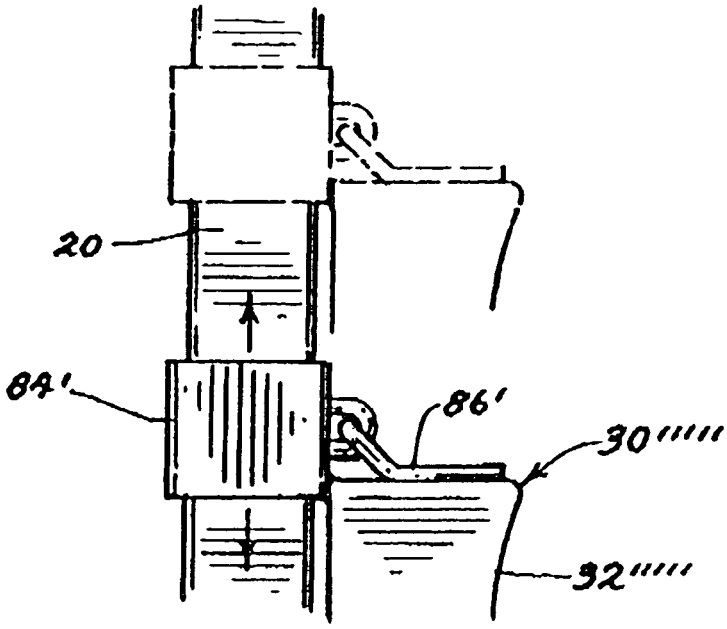
FIG. 17 is a side elevation of the alternate retention member 84' shown in FIG. 16.

Referring now also to FIGS. 15–17, retention members 84, 84' are shown which differ significantly from the retention members 38, 38', 38", 38'" and 38"". These retention members 84, 84' at least partially encircle the mounting uprights 20. As seen in FIG. 15, the retaining member 84 completely encircles the mounting upright 20 and is pivotally interconnected with the alternate mold board 32"" by a securing loop 86, which is welded to the top of the mold board 32"". In FIG. 16, a similar retaining member 84' is shown in which the retaining member 84' only partially encircles the mounting upright 20.

Figure 18:
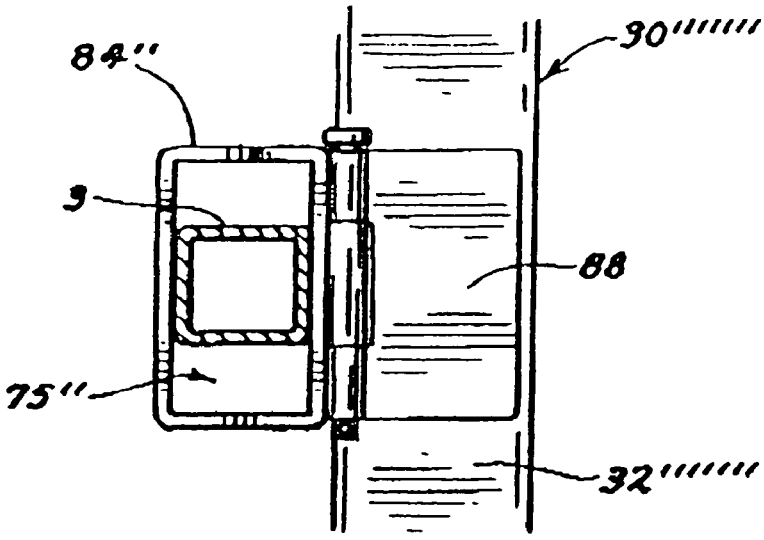
FIG. 18 is a top plan view elevation of a further alternate retention member 84", which is pivotally secured to the alternate plow blade 30'''''.
Figure 19:
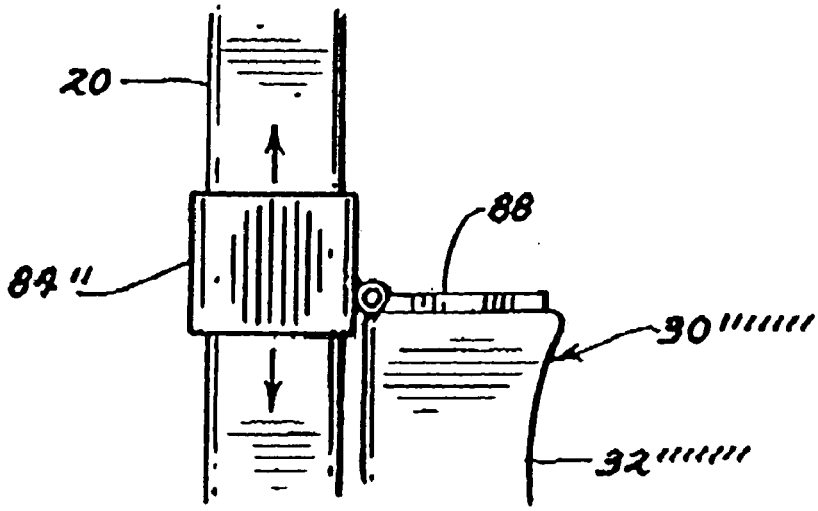
FIG. 19 is a side elevation of the alternate retention member 84" shown in FIG. 18.

Referring now also to FIGS. 18 and 19, a further retaining member 84" is shown, which has a larger opening 75", thereby giving the mounting upright 20 greater latitude when moving side to side within the opening 75". This retaining member 84" is pivotally attached to a securing plate 88 which is welded to the alternate mold board 32""". It will be appreciated that the retaining member 84" may also have an incomplete side similar to that shown in FIG. 16 for retaining member 84'.

Figure 20:
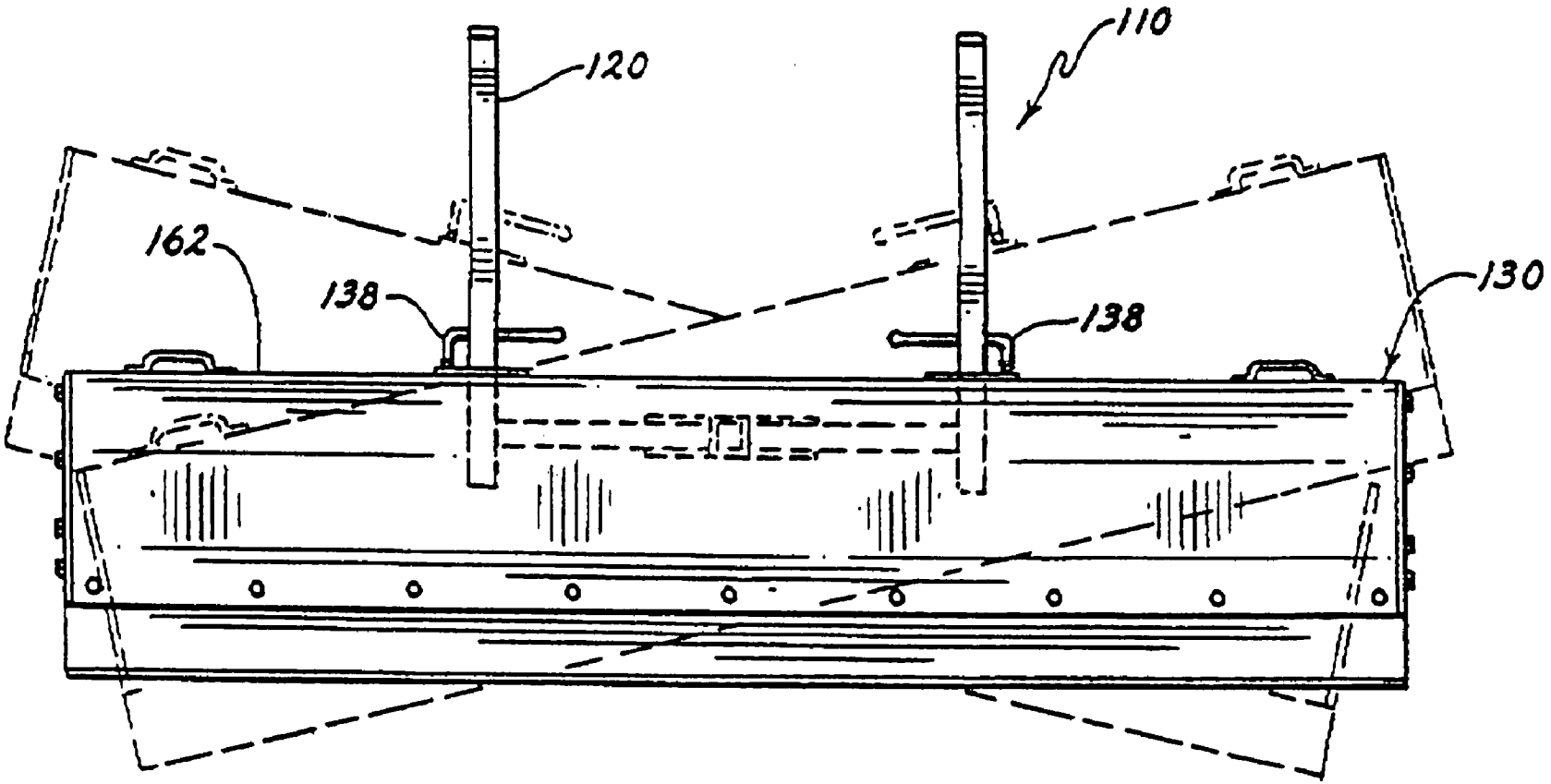
FIG. 20 is a front elevation of an alternate self-adjusting snow plow 110; similar to that shown in FIG. 4 where the plow blade 30' is shown in a working orientation and is shown in phantom in further working orientations when one end or the other is raised with respect to the mounting uprights 20', but the plow blade 130 includes alternate first and second retention members 138, each of which just partially encircles one of the respective mounting uprights 120.
Figure 21:
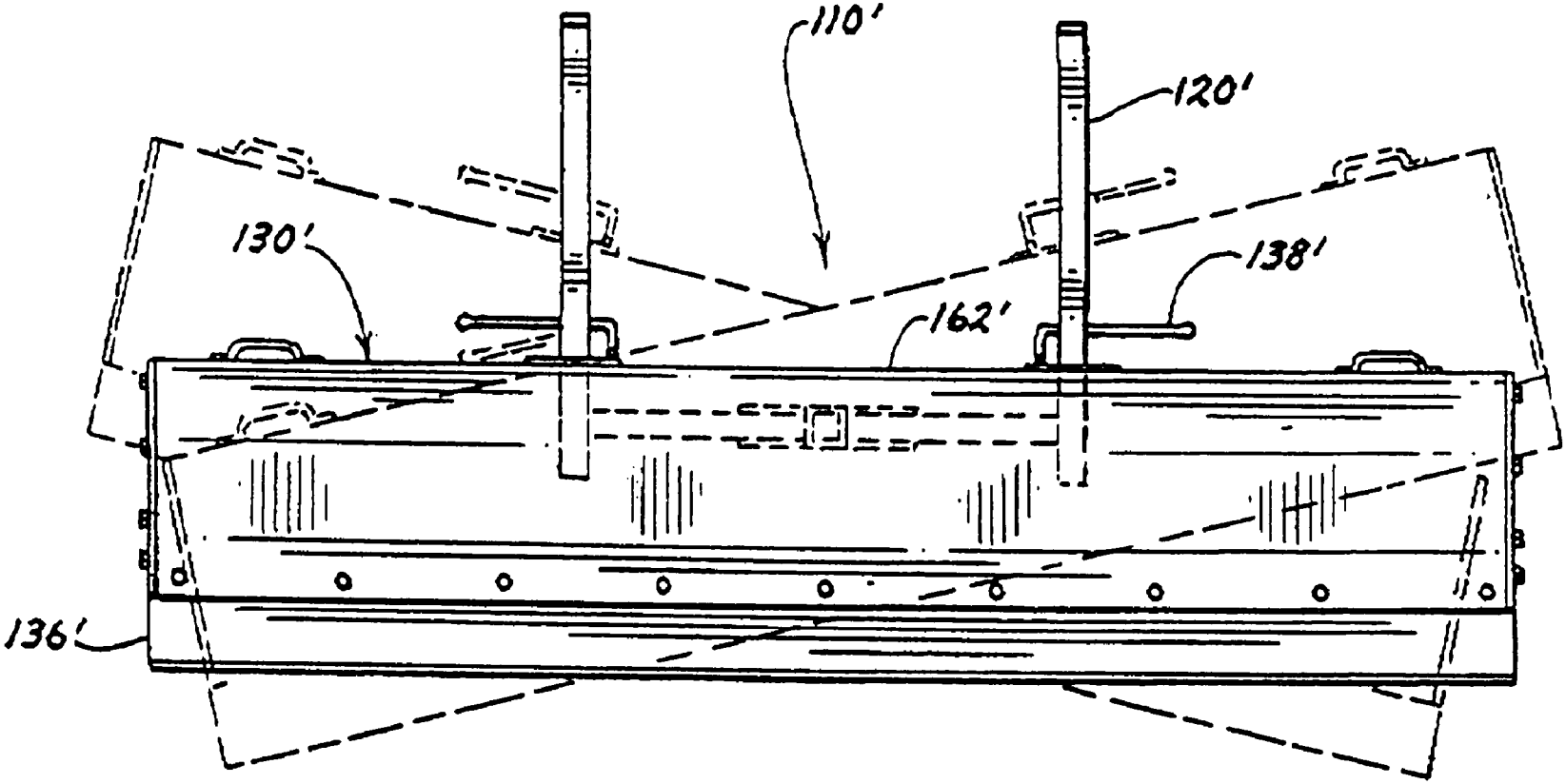
FIG. 21 is a front elevation of an alternate self-adjusting snow plow 110'; similar to that shown in FIG. 4 where the plow blade 130' is shown in a working orientation and is shown in phantom in further working orientations when one end or the other is raised with respect to the mounting uprights 120', but the plow blade 130' includes further alternate first and second retention members 138', each of which just partially encircles one of the respective mounting uprights 120'.
Figure 22:
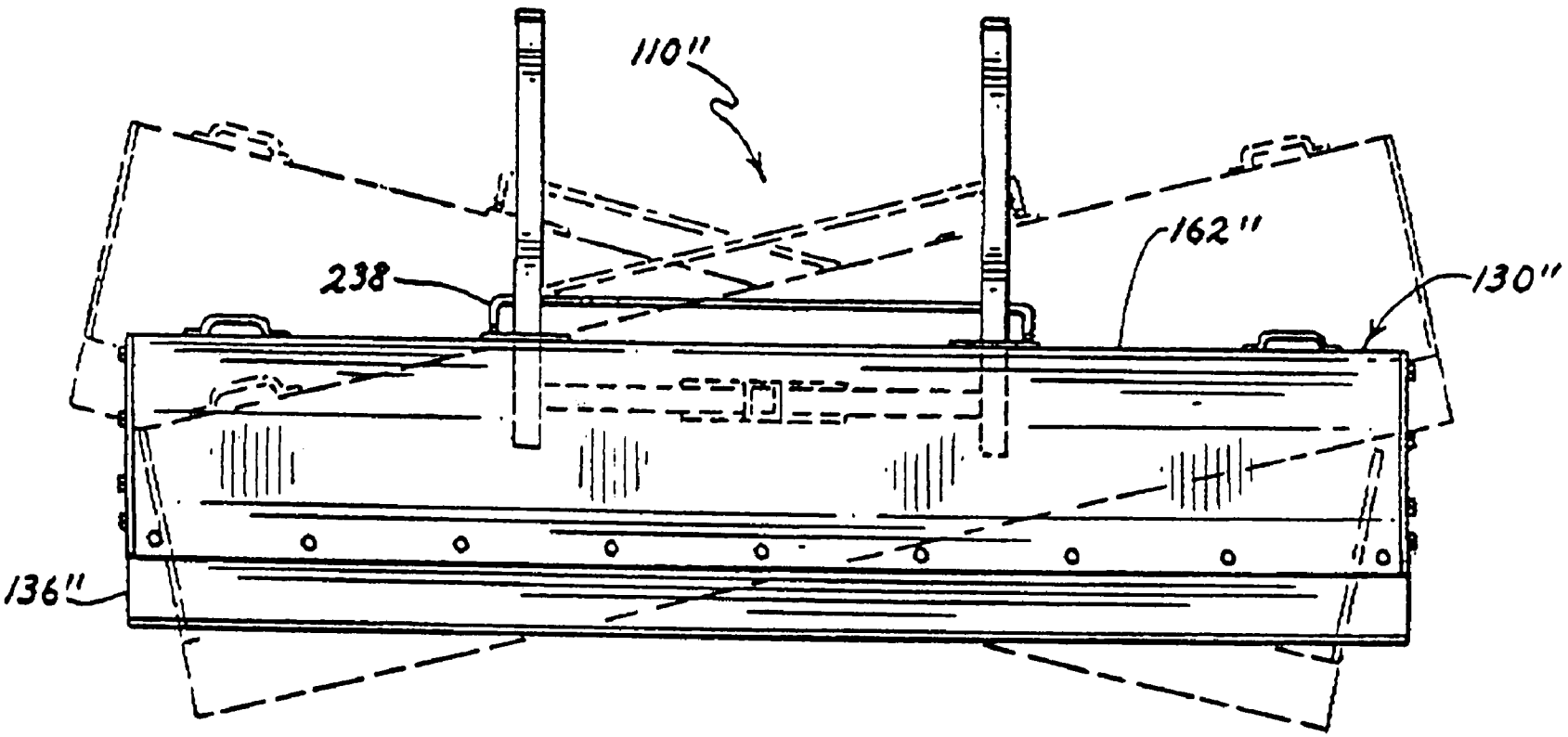
FIG. 22 is a front elevation of an alternate self-adjusting snow plow 110"; similar to that shown in FIGS. 4 where the plow blade 130" is shown in a working orientation and is shown in phantom in further working orientations when one end or the other is raised with respect to the mounting uprights, but the plow blade only includes a single retention member 238 which encircles both of the mounting uprights.

Referring now also to FIG. 20, an alternate embodiment of the snow plow 110 is shown having alternate retention members 138 which only partially encircle the mounting uprights 120 when the plow blade 130 is in a working orientation as shown. Referring now also to FIG. 21, a further embodiment to the snow plow 110' is shown having further alternate embodiments of the retention members 138', extending in an opposite direction as compared to that shown in FIG. 20, but once again only partially encircling the mounting uprights 120' when the plow blade 130' is in a working orientation as shown. Referring now also to FIG. 22, a further alternate embodiment of the plow blade 110" is shown in which a single retention member 238 is attached to the plow blade 130". The retention member 238 is shown in a working orientation and encircles each of the respective mounting uprights 120". Referring now also to FIG. 23, a further alternate embodiment of the plow blade 110'" is shown in which a single retention member 238' is attached to the plow blade 130'". The retention member 238' is shown in a working orientation and only partially encircles each of the respective mounting uprights 120'". In each of the aforementioned alternate snow plow embodiments, the plow blade may be disengaged from the respective mounting uprights one mounting upright at a time or, as is also the case with each of the other aforementioned embodiments, the plow blades may be disengaged from the mounting uprights at the same time, if both ends of the plow blade are lifted and disengaged at the same time.

In preferred embodiments, the mold board 32 of the plow blade 30 is a hollow extruded aluminum structure. In the most preferred embodiments, the aluminum surface will be clear anodized aluminum which is particularly attractive for consumers. Although the mold board can be extruded into two pieces (not shown) which are subsequently assembled, the preferred embodiment is a one-piece extrusion which saves both on cost for aluminum and on cost for assembling the mold board. In preferred embodiments, the plow blade will weigh less than about 150 pounds, preferably less than about 110 pounds. The entire snow plow 10, including the mounting apparatus will preferably weight about 250 pounds or less, more preferably about 225 pounds or less.

When force is applied to the rubber scraper 36 of the present invention, the bottom of the rubber scraper 36 will bend backwards as shown in FIG. 1 and in FIG. 9 in reference to the alternate embodiment 30'. The rubber scraper 36 will generally bend at a generalized pivot point 81' which is located just below the lower edge of the scraper channel 34 within the mold board 32. In softer rubbers having a durometer of 40 or 50, the rubber scraper 36 tends to bend more. For that reason, harder rubbers having a durometer of at least about 60, perhaps as much as about 70 or 80, are preferred.

When installing the mounting apparatus 14, it is easiest to install the mounting uprights 20 in a perfectly vertical position as this is easiest to corroborate if a carpenter's level is available for use during the installation. It is possible, however, to tip the mounting uprights 20 either forward or backward a small amount. When the uprights 20 are tipped backward, the plow blade 30 tends to rise somewhat more easily when it comes into contact with moveable objects, including accumulated snow 58 on the ground 56. When the uprights 20 are tipped slightly forward, this tends to put pressure on the rubber scraper 36 and it is believed that the plow blade 30 will not rise up on the mounting uprights 20 quite as easily as it will when the mounting uprights 20 are perfectly upright. In certain embodiments, however, it may be desirable to tilt the uprights 20 forward about two and one-half degrees from vertical. This will allow the rubber scraper 36 to flex to a higher degree and appears to have a shock dampening effect during snow removal. Also, because the mounting uprights 20 are tilted forward, it has an added effect of keeping the plow blade 30 down when it is in use. In certain situations, this is most desirable as a user may be able to obtain superior results when the blade 30 rises somewhat less readily or when the scraper 36 comes under a lower degree of force. In this regard, it is also noted that the rubber scraper 36 needs to extend outward in front of the mold board 32. It is believed that if the rubber scraper 36 were straight up and down, the blade 30 would lift up too easily and the snow 58 would squirt under the blade 30 and result in poor snow removal. It is also noted that the rubber end caps 46 will tend to bow outwardly even as great as 90 degrees to the direction of the movement of the plow blade 30. This is desirable as it allows the blade to catch more snow when moving it.

An alternative embodiment of the present invention, shown in FIG. 6, in which the angle of the plow blade 30" can be varied in relation to its direction of travel. This embodiment is a pivoting snow plow 79 and allows the user to discharge snow on either side of the plow vehicle 18. In this embodiment of the invention, the connection of the hitch tongue 24" to the plow blade 30" is facilitated through the use of a pivot plate 42. The pivot plate 42 provides the point of attachment for a forward mounted mount bolt 77 which fastens the interconnecting member 22" to the hitch tongue 24" while allowing the plow blade 30" to pivot around it.

Additionally, the pivot plate 42 is equipped with a plurality of alternate locking holes 78, which, when used in conjunction with the locking pin 21, are used to lock the pivoting plow 79 into positions that push snow straight ahead, as shown in FIG. 6, or to the left or the right as shown in phantom in FIG. 6. This allows the user to employ this embodiment of the present invention in a plurality of orientations. The first of these is to lock the pivoting plow 79 in the position in which the plow blade 30" is generally perpendicular or square in relation to the line of travel. Conversely, to employ the side discharge function, the user simply locks the pin 21 in the desired alternate locking holes 78 to discharge the snow on a desired side of the vehicle 18 (not shown) pushing to snow plow.

Subsequent to the initial development of the present invention, certain aspects of the invention were enhanced to develop the invention in ways that will make commercial embodiments of the self-adjusting snow plow of the present invention especially desirable to users.

Referring now also to FIGS. 24, 25A, 25B, and 26–28, a commercial embodiment of the self-adjusting snow plow 310 is shown. The self-adjusting snow plow 310 includes a mounting apparatus 314 having an interceptor 323 interconnected with a mounting frame 309. The interceptor 323 includes a hitch tongue 324 which can be received by a hitch, receiver 316 (shown in phantom) that is attached to the front of a vehicle (not shown) in a manner similar to that disclosed in relation to the embodiment shown in FIGS. 1–3 and 7. The interceptor 323 also includes an optional angle interceptor 311, which will be further described below. The optional angle interceptor 311 is interconnected to the hitch tongue 324 by a hitch tongue extension 308 that is pivotally connected to the optional angle interceptor 311 by a pivot pin 377. The optional angle interceptor 311 includes a flat securing plate 328 that is secured to the interconnecting member 322 of the mounting frame 309 by a series of bolts 325 secured by a series of nuts 326. The mounting frame 309 includes a pair of mounting uprights 320, preferably 33 inches apart on center, connected by the interconnecting member 322.

The plow blade 330 includes a mold board 332 having upper and lower attachment channels 301, 302 respectively, in which a variety of elements, described below, of the plow blade 330 are secured or anchored, preferably by a series of threaded bolts 303 received by a series of reciprocally threaded nuts 304, preferably square nuts. In this regard, it will be appreciated that, threaded bolts and reciprocally threaded nuts are preferred, other fastening mechanisms known in the art may be used to secure the various parts of the present invention.

The plow blade 330 also includes end caps 346 and end plates 348 similar to those described in relation to the embodiments disclosed in relation to FIGS. 1–3, 7–8 and 11. In addition, a pair of guide shafts 387 are secured to the respective ends of the mold board 332, preferably with a pair of fasteners, one of which is normally used to secure the end plate 348 and the end cap 346 in a screw receiving channel 349 in the extruded aluminum mold board (see FIGS. 25A and 25B). Which also illustrate a preferred rubber scraper 336 similar to those disclosed in relation to the first embodiment of the present invention disclosed in FIGS. 1 and 7–8, as well as the scraper channel 334 in the mold board 332 in which the rubber scraper 336 is secured.

Although a two piece or multiple piece aluminum extrusion can be used to form the mold board 332, a single piece aluminum extrusion is believed to be more efficient and to provide a more cost effective structure in so far as no assembly is required. The mold board 332 shown without any attachments in FIG. 25B is the most preferred embodiment of the mold board. It includes a series of internal support structures 353 that strengthen the extruded mold board 332 by standing between and connecting the exterior walls 354 of the extruded mold board 332, just as the internal support structures in the earlier embodiments strengthened the mold board 32 previously disclosed.

The plow blade 330 disclosed in FIGS. 24, 25A, 25B and 26–28 include two lifting handles 340 on opposite ends of the mold board 332, anchored in the upper attachment channel 301, two retention hooks 341, also secured in the upper attachment channel, but placed closer to the middle of the mold board 332 and two retention apparatus assemblies 337 including a retention member 338 welded to a retention plate 339 that is anchored by two threaded bolts 303 secured to reciprocally threaded nuts 304 and the upper attachment channel 301 and two threaded bolts 303 anchored in reciprocally threaded nuts 304 in the lower attachment channel 302.

Figure 24:
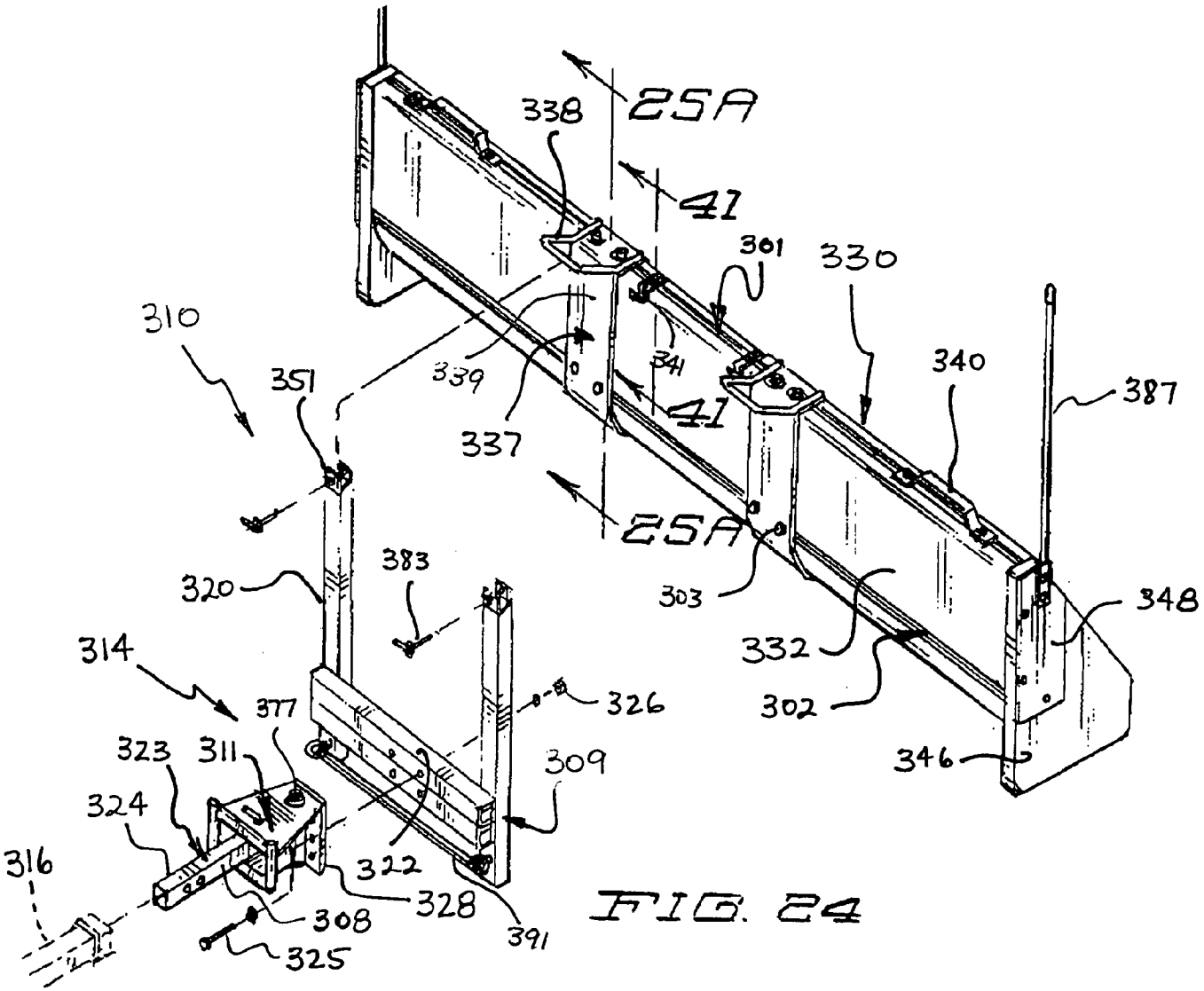
FIG. 24 is an exploded perspective view, similar to that shown in FIG. 7, but showing a new embodiment of the snow plow 310 of the present invention having an extruded aluminum mold board 332 having attachment channels 301, 302; and showing another alternate mounting apparatus 314 having a pivotal swivel apparatus 311 for pivoting the mounting frame 309 with respect to the direction of travel of the vehicle (not shown) in a manner somewhat similar to the manner in which the alternate mounting apparatus 14', shown in part in FIG. 6, functions, but in a different way; and also providing alternate mounting uprights 320 having alternate attachment members 351, and also showing engagement apparatus (e.g. retention hook 341) for engaging to the plow blade 320, a resilient elongated member 391, secured to the alternate mounting apparatus 314 when the plow blade 320 is in a working orientation for use during snow plowing operations.
Figures 25A, 25C:
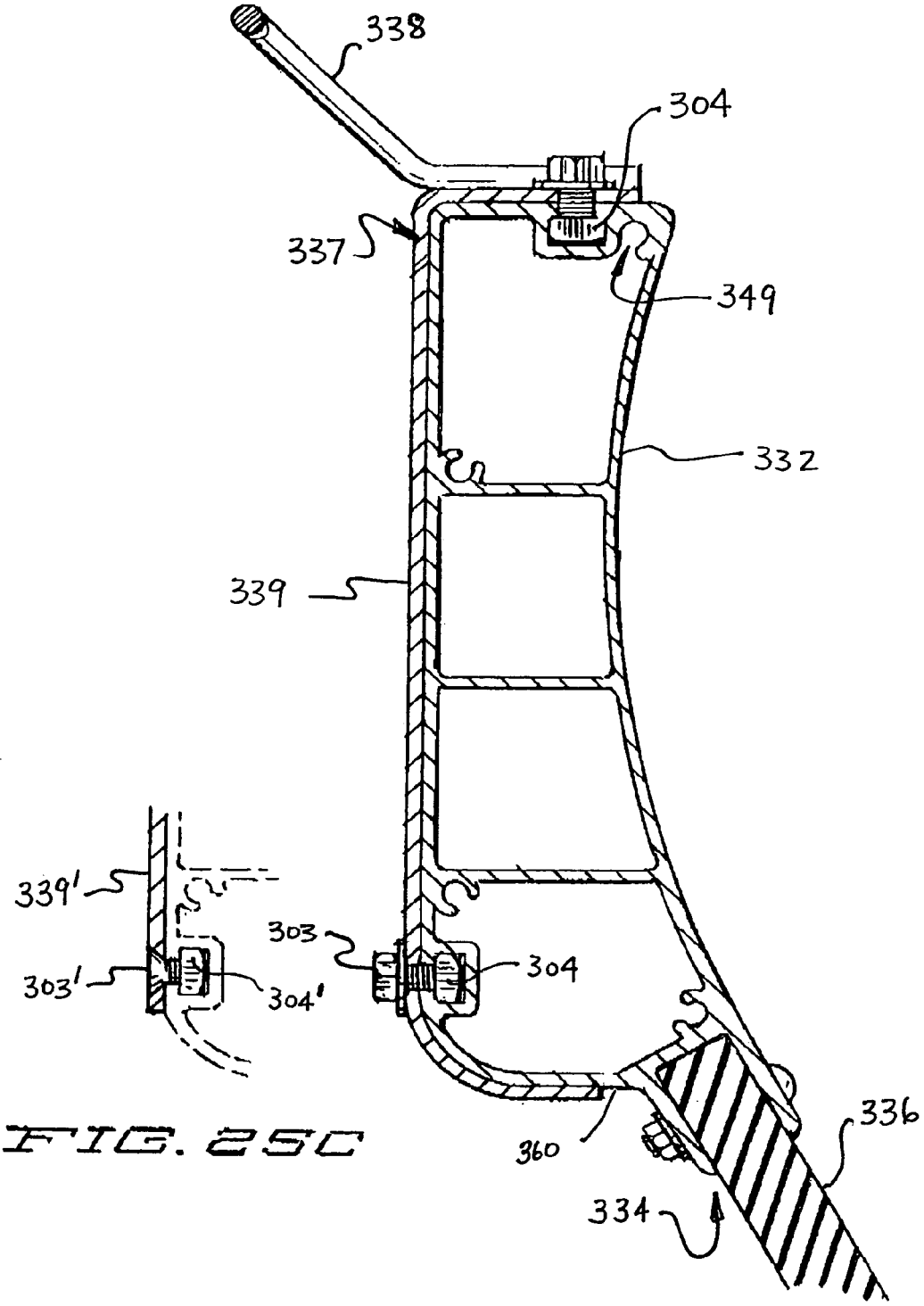
FIG. 25A is a cross-sectional view of the alternate plow blade 320 of the improved snow plow 310 shown in FIG. 24, as seen from the line 25—25 in a manner similar to that shown in FIG. 8 for the embodiment shown in FIG. 7.
FIG. 25C is a view similar to that shown in FIG. 25A, but showing only a portion of the plow blade 320 that is changed to shorten the metal plate 339' to which the retention member is welded and to provide a counter-sunk screw 303' that secures into the nut 304' in the attachment channel 302, rather than a bolt and washer as shown in the embodiment shown in FIG. 25A.
Figure 25B:
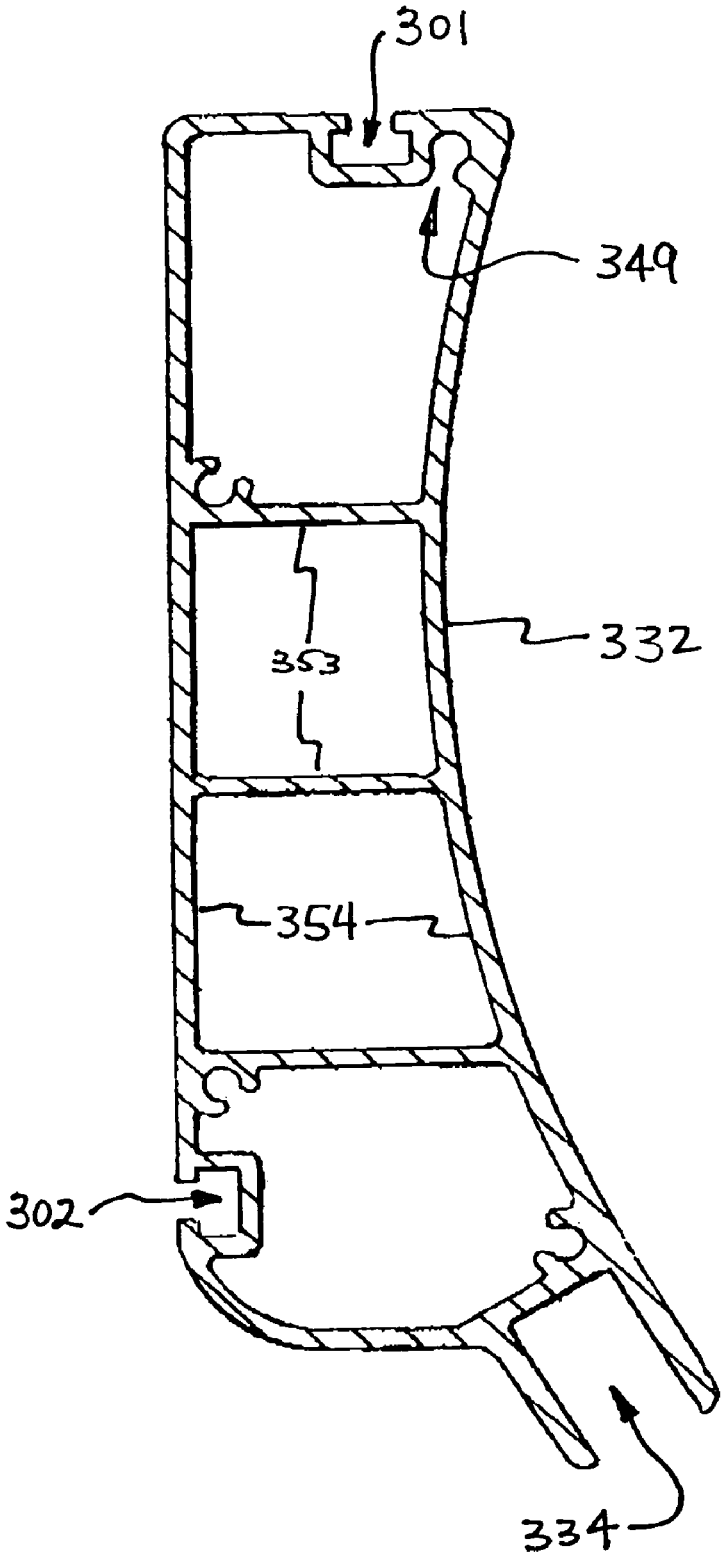
FIG. 25B is a cross-sectional view just like that shown in FIG. 25A, except that only the mold board 332 is shown and all the other parts of the plow blade 320 shown in FIG. 25A have been removed to show the attachment channels.

Referring now also to FIG. 25C, an alternate metal retention plate 339' is shown in part where it differs from the alternate retention plate 339' shown in FIGS. 24, 25A and 25B, only in that it is truncated at the bottom 360 of the mold board 332 and does not extend as far as the retention plate 339' shown in FIG. 25A. In view of the lower cost of the alternate retention plate 339' is more cost effective, due in part to lowered tolerance requirements associated with the turn in the retention plate reciprocating the turn in the mold board 332 at the bottom 360 of the mold board the alternate retention plate 339' is preferred as is the counter sunk threaded bolt 303' shown in FIG. 25C having a conical head to secure the lower portion of the retention plate 339' in the lower channel 302.

Figure 26:
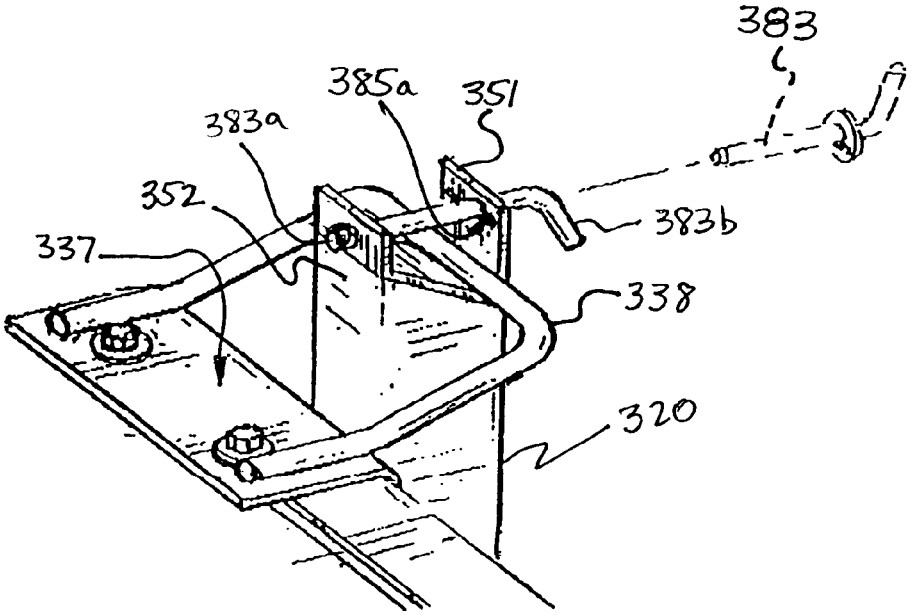
FIG. 26 is a perspective view of a portion of the alternate snow plow 310 shown in FIG. 24, but from a different perspective than that of FIG. 24; one that is slightly less elevated and from about 180 degrees from the view shown in FIG. 24 in a horizontal plane, and showing a retention member 338 of the alternate plow blade 320 engaged in the mounting upright 320 of the alternate mounting apparatus and also showing an additional securing pin 383 in phantom, in an orientation in which it would have to reside in order to be either inserted or removed from an alternate securing pin slot 385*a* of the alternate attachment member 351 shown in this Figure.
Figure 27:
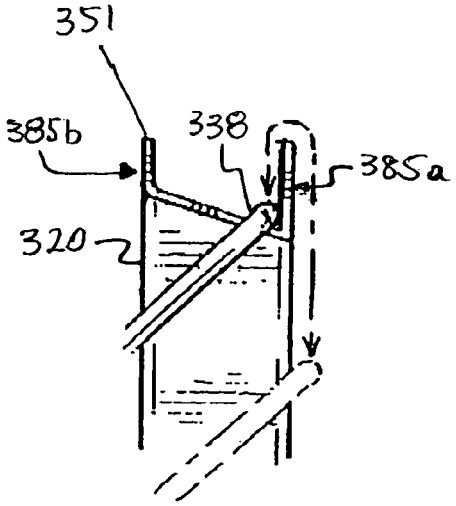
FIG. 27 is a partial side elevational view of elements of the alternate snow plow 310 shown in FIG. 24, that are shown in FIG. 26, with the exception that the securing pin 383 is removed and the retention member 383 is shown in phantom in a transitional orientation in which the retention member 383 would occasionally pass through when the plow blade 330 is either placed in or removed from a resting, non-operational, or transit position, and the retention member 338 is either placed in or removed from the attachment member 351, before or after being in a working or operational position similar to that shown in FIGS. 1 and 9.
Figure 28:
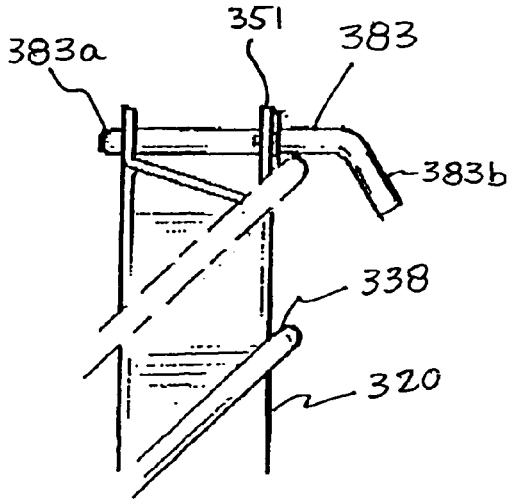
FIG. 28 is a partial side elevational view similar to FIG. 27, but showing the securing pin 383 in an engaged position in the attachment member 351 of the alternate mounting upright 320 and the retention member 338 in solid line, but showing movement of the retention member 338 in phantom to a raised position.
Figure 29:
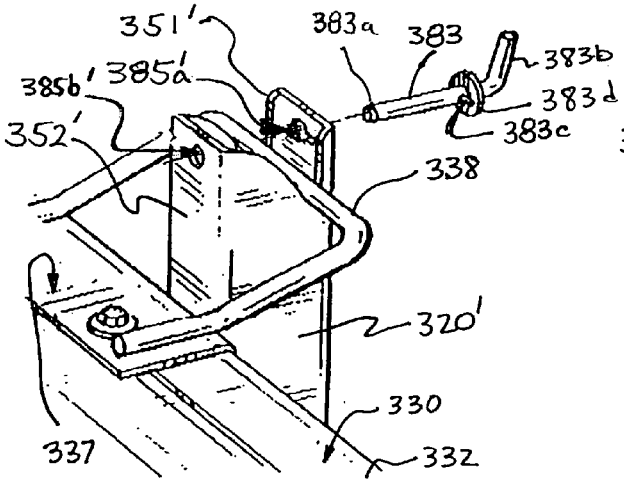
Figure 90:
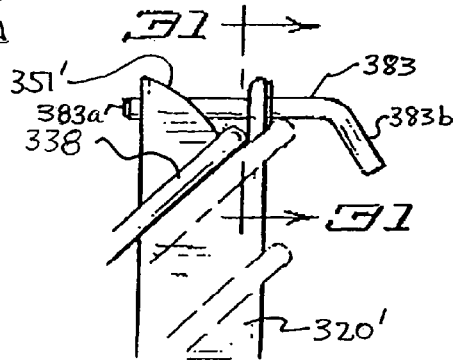
Figure 91:
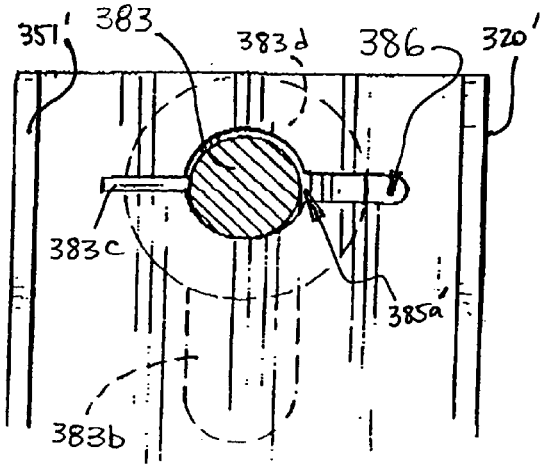
Figure 92:
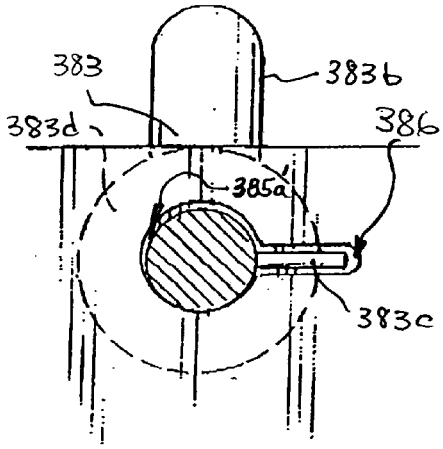
Figure 9D:
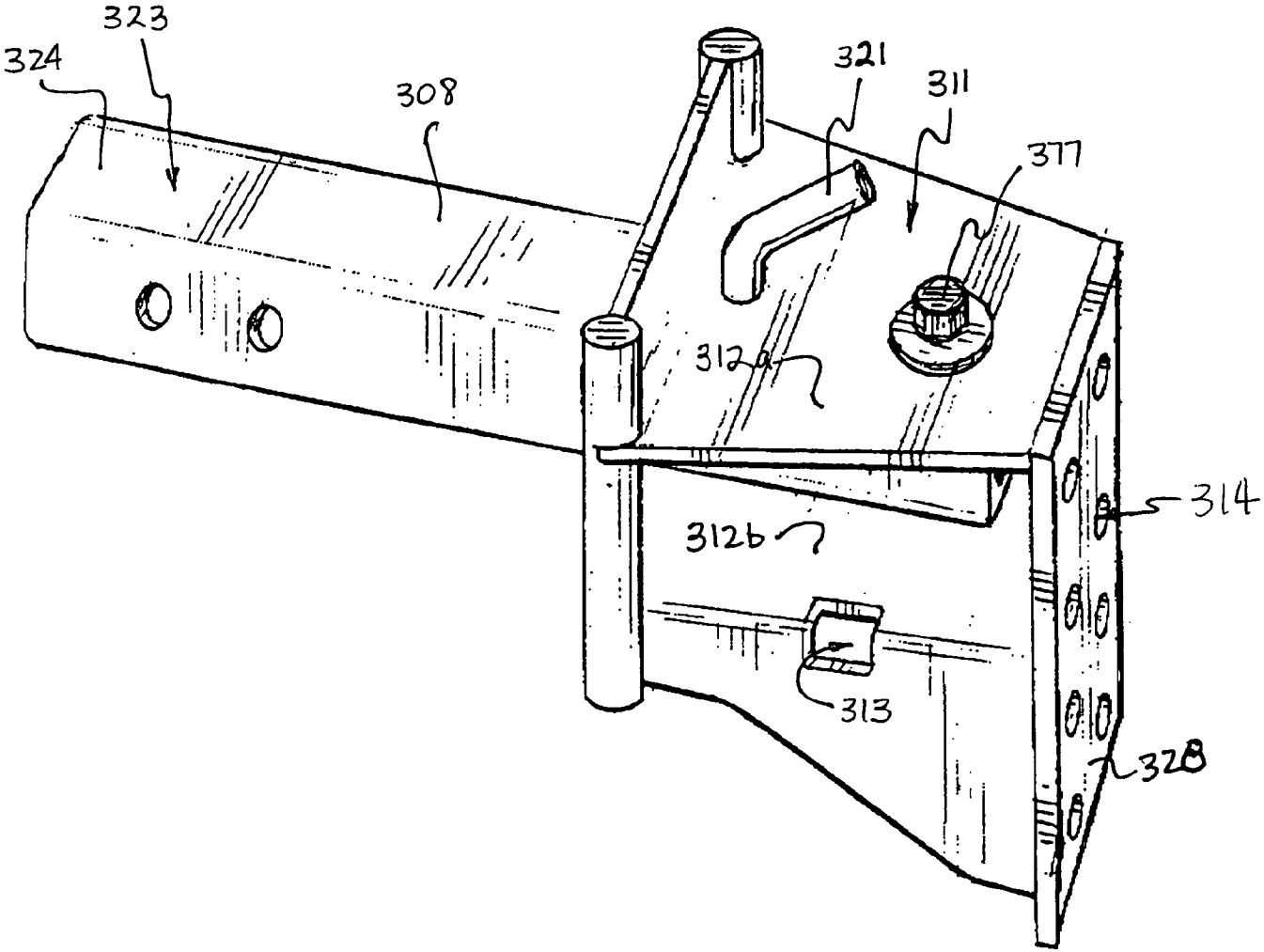

Referring now with particularly to FIGS. 26–28, the alternate mounting uprights 320 include an alternate attachment member 351 that is secured to the top 352 of each of the mounting upright 320. As shown in FIG. 26, the retention member 338 can be secured in the attachment member 351 by a retention pin 383 the retention member 338 can be removed from the attachment member 351 if the retention pin 383 is removed from the attachment member so that the plow blade 330 can be lifted to lift the retention member 338 out of the attachment member 351 and the plow blade can then be lowered into a working orientation by encircling the mounting upright 320 with the retention member 338 and sliding the retention member 338 down along the outer extremity of the mounting upright 320 to engage the retention member 338 to the mounting upright 320. As shown particularly in FIG. 28, the retention member 338 can generally slide freely along the exterior of the mounting upright 320, but it is limited if the retention pin 383 is inserted in the pin retention slots on either side of the attachment member 351. In this way, if the plow blade 330 travels upward along the mounting upright 320 its upward travel along the mounting upright will be limited by the retention pin 383 that will stop the retention member's upward travel when the retention member 338 comes into contact with the retention pin 383.

Figure 29:
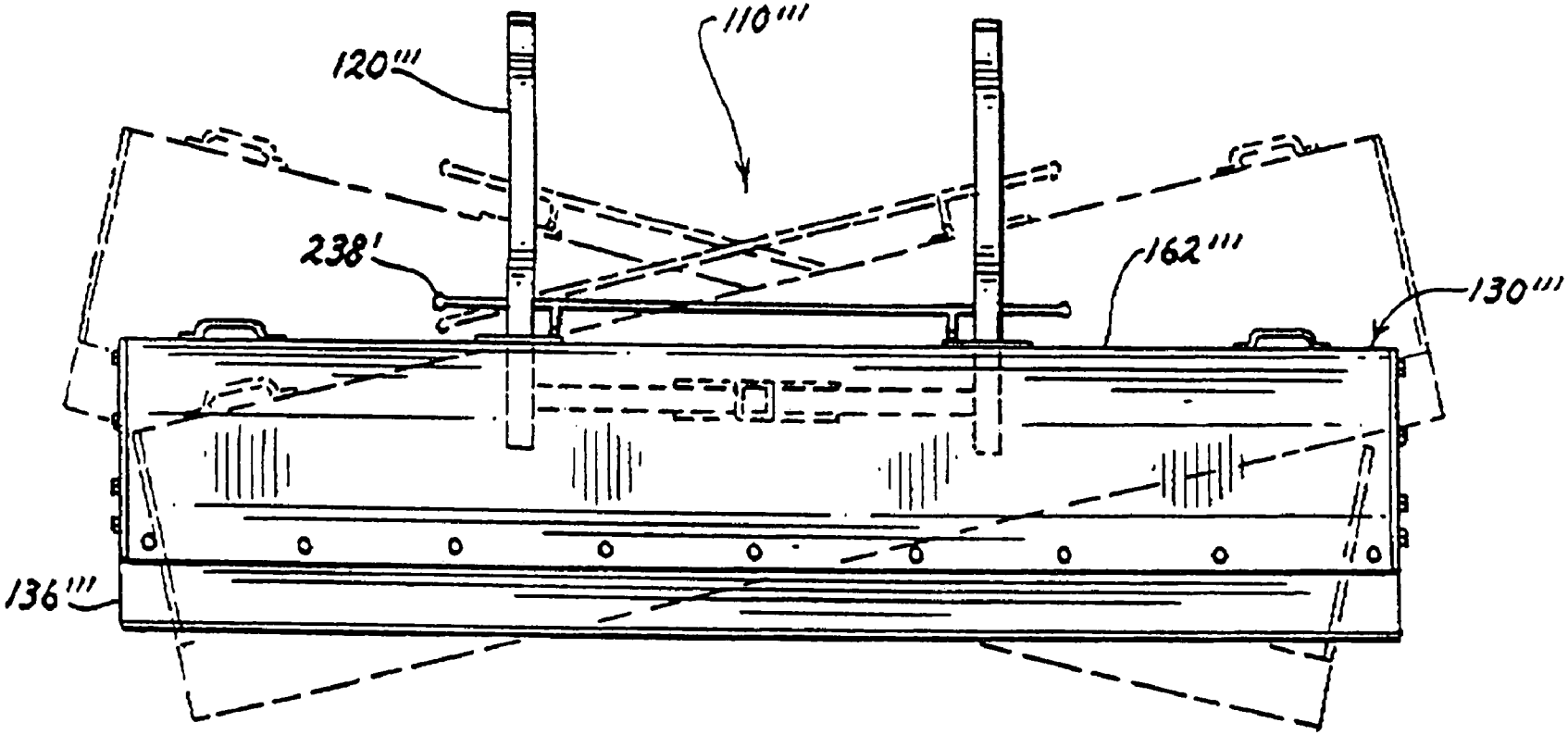
FIG. 29 is a partial perspective view of a further alternate mounting upright 320', shown in a manner similar to that shown in FIG. 26, but showing yet another embodiment of the mounting upright 320' having an attachment member 351' cut into the upper portion of the mounting upright 320', and showing the securing pin 383, in a partial exploded view, out of the securing pin receiving slot 385*a'* in an orientation that will permit it to be inserted in the slot 385*a';*

Referring now also to FIGS. 29–32, a further alternate embodiment of the attachment member 351' is shown as a cut away in the upper portion 352' of a further alternate mounting upright 320'. The retention pin 383 can be inserted into a retention slot 385' and past through the attachment member so that the end 383A of the retention pin passes through a receiving opening 385B on the opposite side of the attachment member 351' in a manner that is the same as the manner in which the retention pin 383 is inserted in the previously described attachment member 351 shown in FIGS. 24 and 26–28. In each case, the retention member 338 is inserted into the retention slot 385A when the retention pin handle 383B is in an upright position as shown in FIGS. 29 and 32 and in phantom in FIG. 26. The end of the retention pin 383A is then passed through the retention slot 385A and then through the receiving opening 385B. It will be appreciated that the handle of the pin has sufficient weight so that it will be drawn to a downward position, 180° from the upward position shown in FIG. 29 and FIG. 32 if the retention pin 383 is resting in a generally horizontal position as it would frequently be when fully engaged in the attachment member 351' or 351, as shown in FIGS. 30 and 28, respectively. As shown in FIGS. 31 and 32, when the retaining pin 383 is inserted into the retaining pin receiving slot 385A when the retaining pin resides in an upright position as shown in FIG. 32, a securing arm 383C of the retaining pin 383 will pass through a secondary slot 386 extending horizontally outward from the center of the retaining pin receiving slot 385A to accommodate passage of the side arm 383C of the retaining pin 383. Once the retaining pin 383 passes far enough into the slot 385A and the receiving opening 385B so that they stop plate 383D of the retention pin is pressed against the exterior of the mounting plate 320' approximate the attachment member 351', the side arm 383C will be within the attachment member 351 or 351' with sufficient leeway to allow the handle 383B to turn downward under the force of gravity or otherwise so that the retaining side arm 383C will hold the retaining pin within the slot 385A, 385A' and the receiving opening 385B and 385B'. Once in place, the force of gravity will hold the handle 383B in a downward position so that the retaining pin 383 will be retained within the slot 285A, 285A' and the receiving opening 385B, 385B' until the handle 383B of the retaining pin 383 is turned upward so that the retaining pin 383 can be removed from the receiving opening 385B, 385B' and the slot 385A, 385A'. Also, as noted elsewhere, the retaining pin 383 will act to limit the upward travel of the retention member 338 along the outer extremity of the mounting upright 320, 320' when the plow blade 330 is forced to travel upward along the mounting upright.

Figure 34:
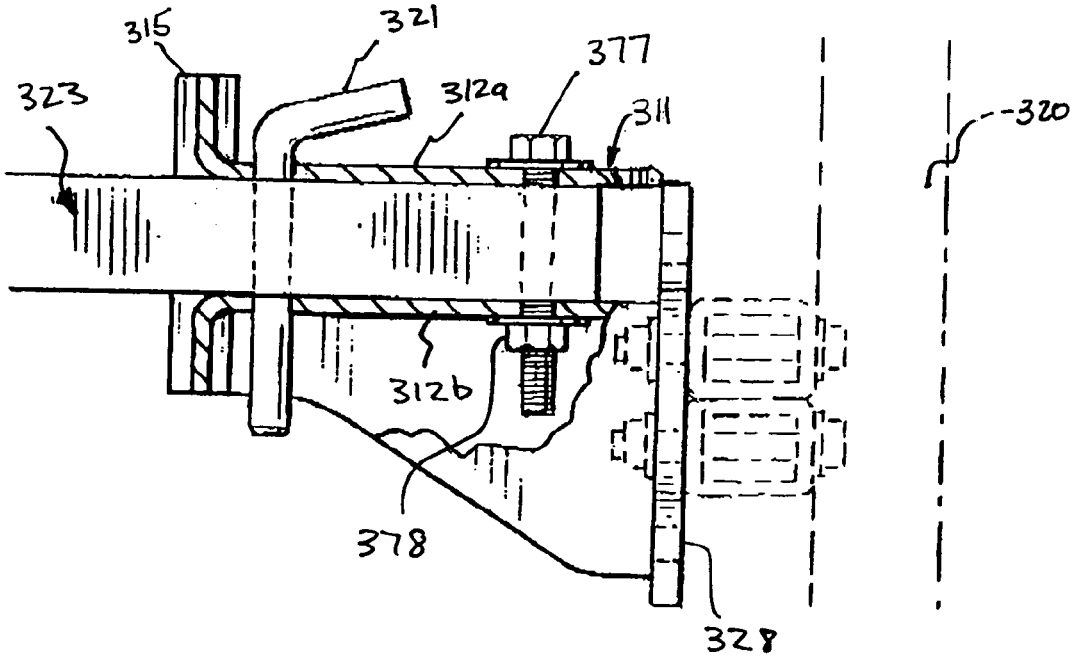
FIG. 34 is a partially broken away side elevational view of the pivoting swivel mechanism of the optional angle interceptor 311 shown in FIGS. 24 and 33, but showing the side of the pivoting swivel mechanism partially broken away to show the upper and lower structural plates 312*a*, 312*b* through which the pivot bolt 377 and the positioning pin 321 pass to orient the mounting frame 309; and showing a channel for the mounting uprights 320 in phantom.

Referring now also to FIGS. 33–37, the optional angle interceptor 311 is interconnected with the mounting frame pins shown in FIG. 24 by a series of threaded bolt fasteners secured to reciprocally threaded nuts 326, shown in FIG. 24; and to the front of a vehicle in a manner similar to that shown in FIG. 7 for the first embodiment, where a hitch tongue 24 similar to hitch tongue 324 shown in FIG. 33 can be secured to a hitch tongue receiver 16, similar to hitch tongue receiver 316 shown in FIG. 24. The interceptor 323 includes the hitch tongue 324 and a hitch tongue extension 308 that is pivotally connected to the optional angle interceptor 311 by pivot pin 377 upon which the interceptor 323 can pivot if the locked pin 321 is removed from the optional angle interceptor 311. As shown in FIG. 34, the optional angle interceptor has an upper plate 312*a* and a lower plate 312*b*. Each of the respective upper and lower plates have a pair of openings, that are aligned in a reciprocating fashion so that, for instance, an opening for receiving the lock pin 321 in the upper plate 312*a* is directly above and aligned with a similar opening in the lower plate 312B so that the lock pin 321 can pass through both openings without difficulty. Furthermore, the remaining openings in the upper and lower plates 312*a*, 312*b* are aligned so that they can receive the pivot pin 377 which is preferably a threaded bolt secured below the lower plate 312*b* by a reciprocally threaded nut 378. It will be appreciated that the optional angle interceptor has three opened sides between the upper plate 312*a* and the lower plate 312*b*. This design is especially helpful to permit snow, ice, water, sand and the like to escape from the area between the respective plates so that it won't interfere with the movement of the hitch tongue extension 308, through which the pivot pin 377 passes.

The structure of the optional angle interceptor also includes a drain opening 313 in the lower plate 312*b* so that, if the optional angle interceptor is turned upside down 180° from the orientation shown in FIG. 33, water, snow, ice, sand and the like will fall out of the drain opening 313 to limit collection of such materials above the lower plate 312*b* that will be, in effect, the upper plate when the optional angle interceptor is turned upside down. It will be appreciate that the optional interceptor can be used in either of these two orientations and that the plurality of both receiving openings 314 in the flat plate 328 will facilitate placement of the optional angle interceptor at various heights with respect to the mounting frame 320 so as to accommodate vehicles having hitch tongue receivers that will connect at various heights above the ground given the varying characteristics of the plethora of vehicles to which such a hitch receiver may be attached. In this way, the plurality of both receiving openings 314 in the flat plate 328 allow the optional angle interceptor to have significant versatility for attachment of the mounting frame at various heights were attached in anticipation of attachment to a number of vehicles to which a hitch tongue receiver is secured.

Figure 35:
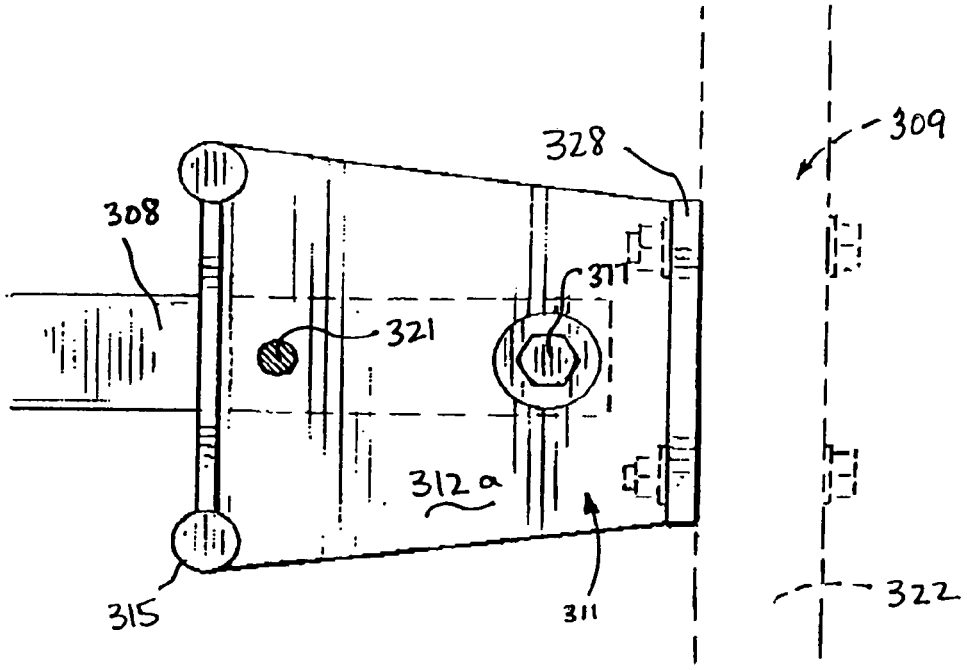
FIG. 35 is a top plan view of the pivoting swivel mechanism of the vehicle connection member 323 shown in FIG. 33 showing the interconnection member 322 of the mounting frame 309 (shown in phantom) in a generally perpendicular orientation with respect to the direction of travel of the vehicle (not shown) to which the mounting apparatus 314 would be interconnected, with the exception that the angle setting pin 321 is shown in cross-section.
Figure 36:
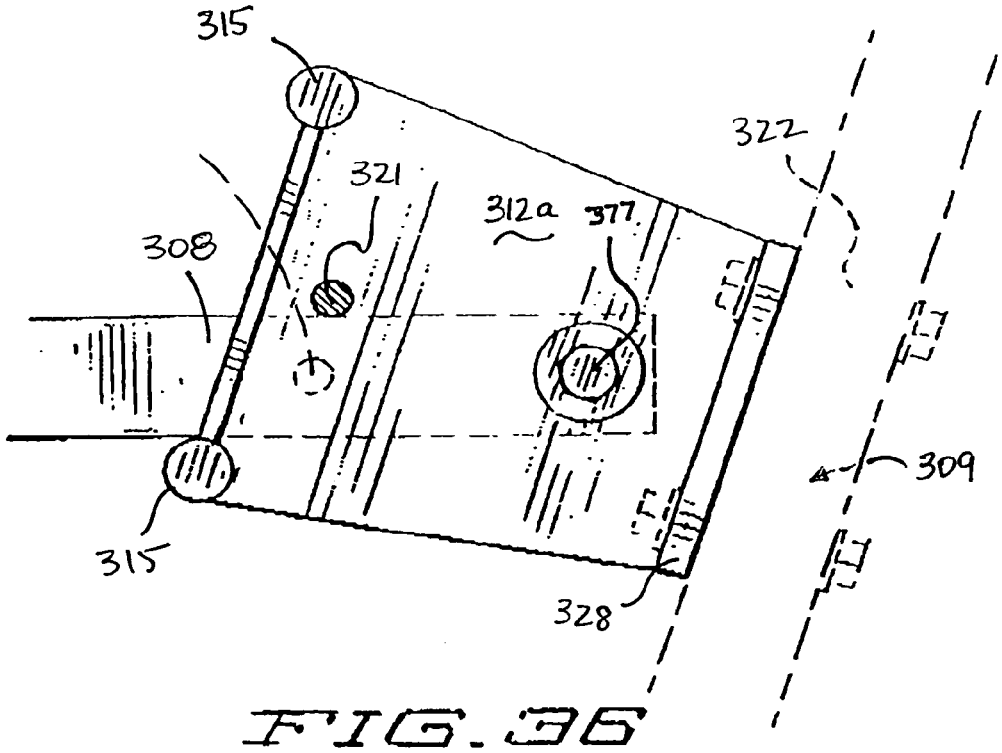
FIG. 36 is a top plan view similar to that shown in FIG. 35, but showing the mounting frame 309 (shown in phantom) turned to the right from the perpendicular orientation shown in FIG. 35.
Figure 37:
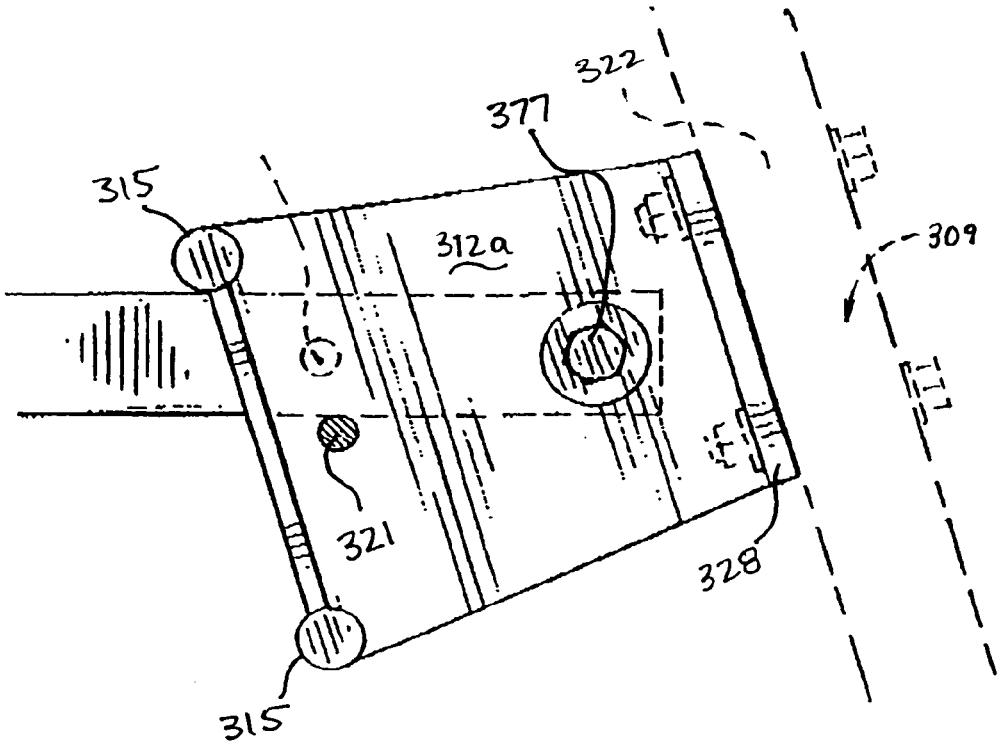
FIG. 37 is a top plan view similar to that shown in FIG. 35, but showing the mounting frame 309 (shown in phantom) turned to the left with respect to the perpendicular orientation shown in FIG. 35.
Figure 98:
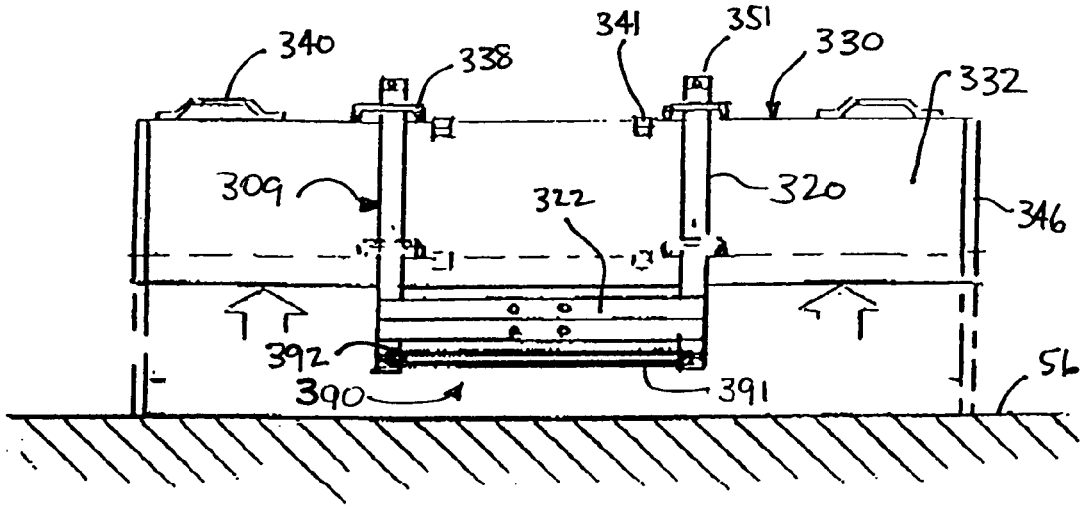
Figure 99:
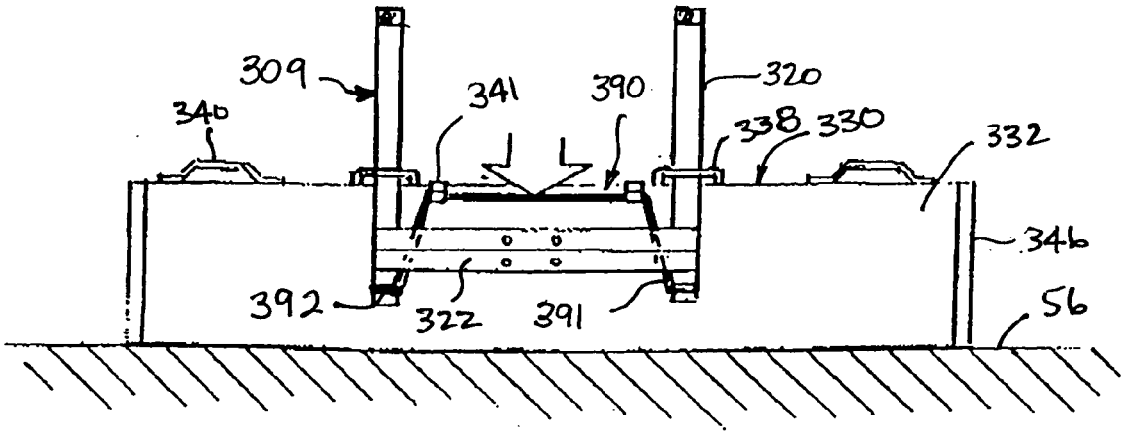

It will be appreciated that the mounting frame 309 will stand generally perpendicular to the direction of movement of a vehicle when the hitch tongue extension is locked in the position shown in FIG. 35 by the lock pin 321. Referring now especially to FIGS. 36 and 37, if the lock pin 321 is removed from the lock pin receiving openings in the upper plate 312*a* the hitch tongue extension 308 and the lower plate 312*b*, the hitch tongue extension 308 can pivot with respect to the optional angle interceptor 311 through a generally horizontal plain until the hitch tongue extension 308 comes into contact with a limiter column 315 on either side of the aligned pin receiving openings in the upper and lower plates 312*a*, 312*b*. It will be appreciated from a review of FIGS. 35–37 that the limiter columns 315 allow the hitch tongue extension 308 to pivot just far enough to permit the lock pin 321 to hold the hitch tongue extension 308 in a position either to the left or the right of the aligned lock pin receiving openings in the upper and lower plates 312*a*, 312*b* so that the lock pin 321 can hold the hitch tongue extension 308 in position with respect to the upper and lower plates 312*a*, 312*b* so that the mounting frame 309 can be held at an angle to the left or to the right of a position perpendicular to the forward movement of a vehicle pushing the adjustable snow plow apparatus of the present invention, so that the plow blade 320 can be held at an angle to the forward motion of the self-adjusting snow plow that is greater than 90° and allows snow gathered in front of the plow blade 320 to be pushed off to one side or the other of the path of a vehicle pushing the plow blade.

Referring now also to FIGS. 38–39, the present invention includes a mounting apparatus 14, 314 having a mounting frame 309, the mounting frame 309 including two interconnected mounting uprights 210, 320; the snow plow retention apparatus 336, preferably including at least one retention member 338, preferably two retention members 338, constructed and arranged to disengageably secure the plow blade 30, 330 to the mounting uprights 20, 320 during use; and an elongated member 390, preferably a resilient elongated member constructed and arranged to place downward force upon the plow blade 30, 330 when the plow blade 30, 330 is disengageably secured to the mounting uprights 20, 320 during use and the elongated member 390 is interconnected between the plow blade 30, 330 and the mounting apparatus 14, 314. In an alternate embodiment of the elongated member shown in FIGS. 38 and 39, the elongated member is a resilient shock chord 391 or bungi cord that is preferably stretched or pre-loaded to extend between two eyebolts each of which is secured to a bottom portion of the mounting frame 309 in the manner shown in FIG. 38. The pre-loaded shock chord is capable of placing a downward force upon the plow blade when the shock chord 391 is further stretched to engage retention hooks 341 secured to the mold board 320 as previously described. By stretching the shock chord 391, which is secured to the bottom of the mounting uprights 320 as shown in FIG. 38, a significant amount of downward force is placed upon the plow blade when it is in a working orientation as shown in FIG. 39.

Figure 41B:
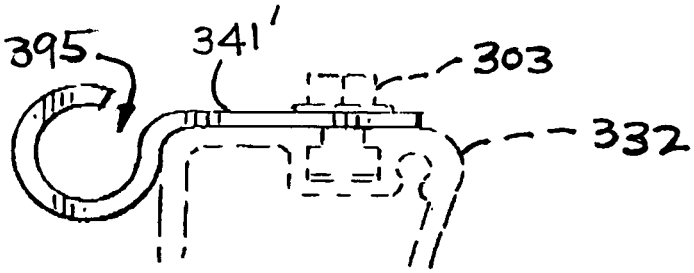
FIG. 41B is a view similar to that shown in FIG. 41A, except that a further alternate attachment hook 341' is shown.
Figure 41A:
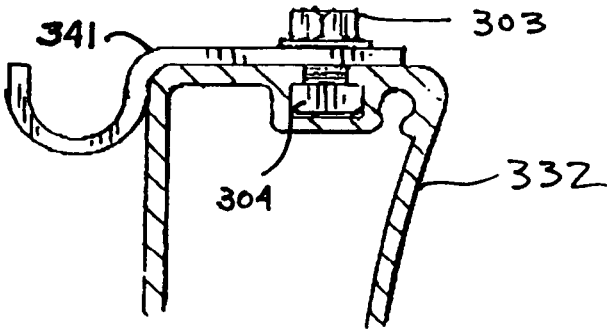
FIG. 41A is a cross sectional view of an upper portion of the plow blade 320 shown in FIG. 24 as seen from the line 41—41, but showing an alternate attachment hook 341 secured in the upper attachment channel 301 of the alternate plow blade 320 shown in FIG. 24.
Figure 42:
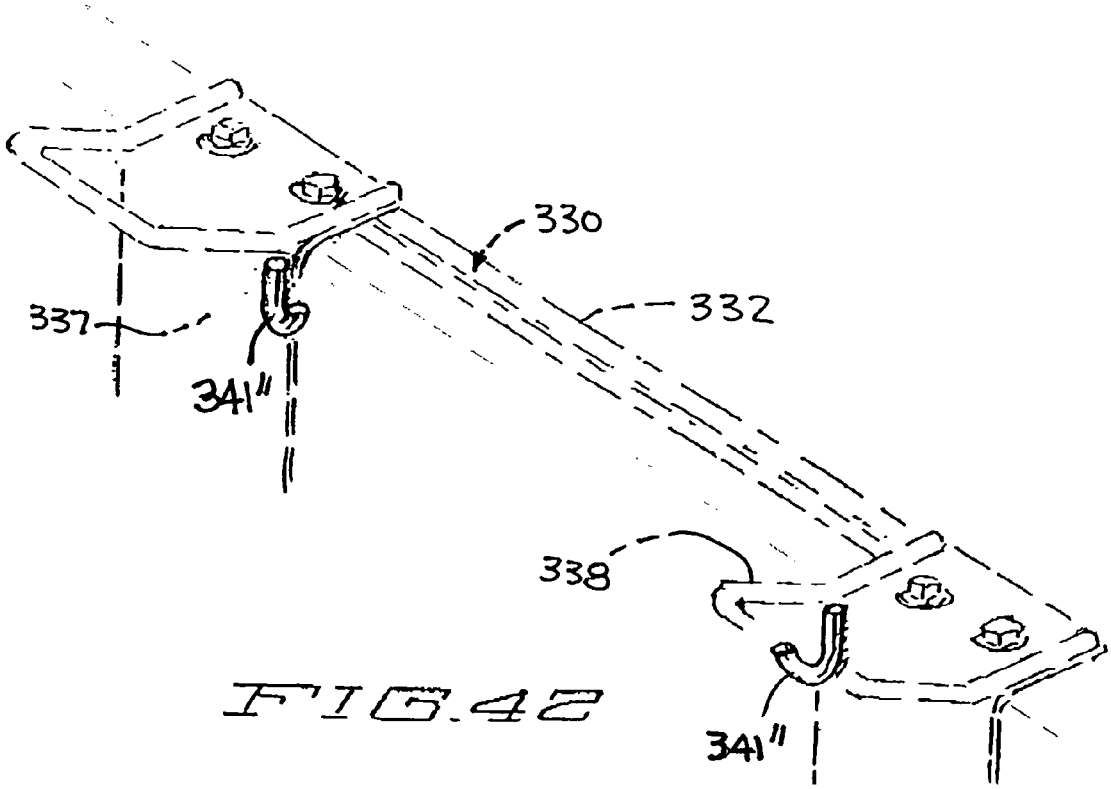
FIG. 42 is a perspective view of an alternate hook apparatus 341" secured to a mold board 332 similar to that shown in FIG. 24.
Figure 43:
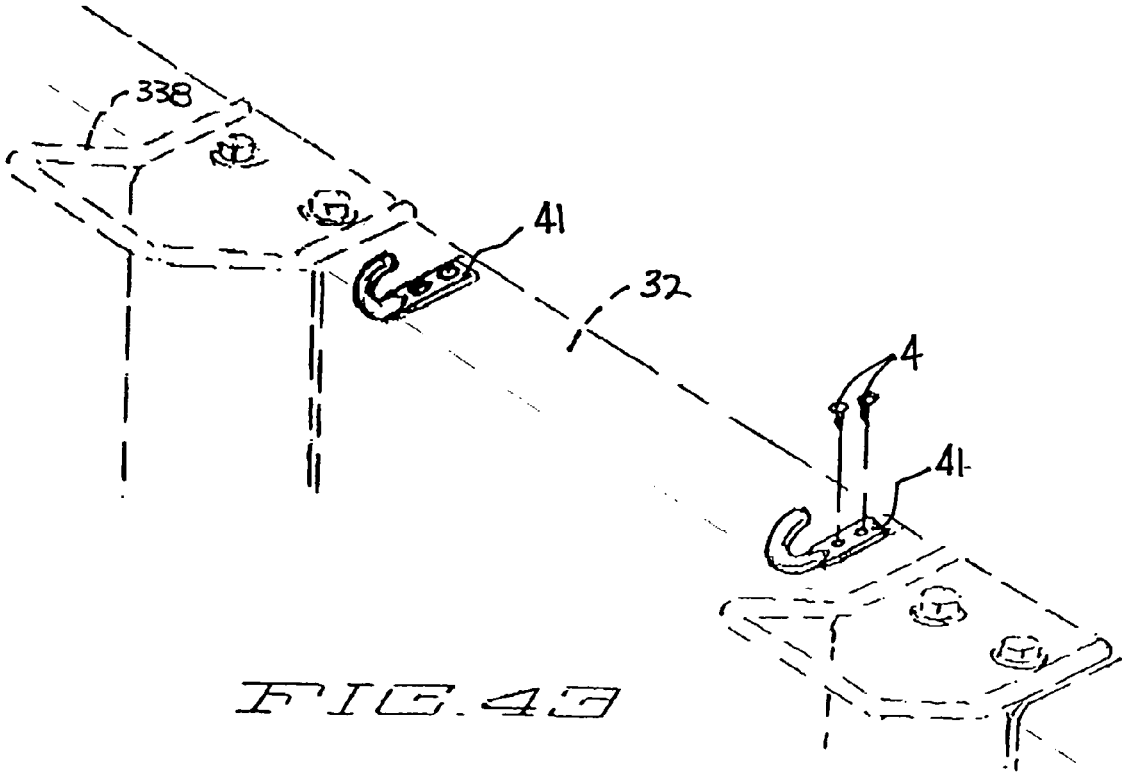
FIG. 43 is a perspective view similar to FIG. 42, but showing a further alternate hook apparatus 41 fastened to a mold board 32 similar to that shown in FIG. 7 and showing the screws 4 used to secure one of the two alternate attachment hooks 41 exploded away from the mold board 32 on one side.

Referring now also to FIG. 41A, the retention hooks 341, shown also in FIGS. 24, 38 and 39, are preferably made of eight inch steel strap material having a width of from about a half an inch to about an inch and a quarter, preferably about three quarters of an inch to about an inch, most preferably about an inch wide. Referring now also to FIGS. 41B, 42 and 43, further embodiments of the retention hooks 341', 341" and 41 are shown. The retention hook 341' shown in FIG. 41B turns to more than 270° and leaves a relatively small opening 395 through which to engage the elongated member 391 with the retention hook 341'. The retention hook 341" shown in FIG. 42 are welded to the retention apparatus assembly 337 to which retention members 338 are secured to the preferred retention hooks 341" and are made of one-quarter inch steel wire from material that is formed to have a U-shape and welded to the retention apparatus assembly 337 that is secured to the mold board 332 as previously described. Referring now also to FIG. 43, a pair of standard hooks 41 may also be used when secured to a mold board 32 such as that shown in FIG. 43 which is similar to that shown in FIGS. 7 and 8. The retention hooks 41 are secured to the mold board 32 with a pair of threaded screws 4.

Figure 40:
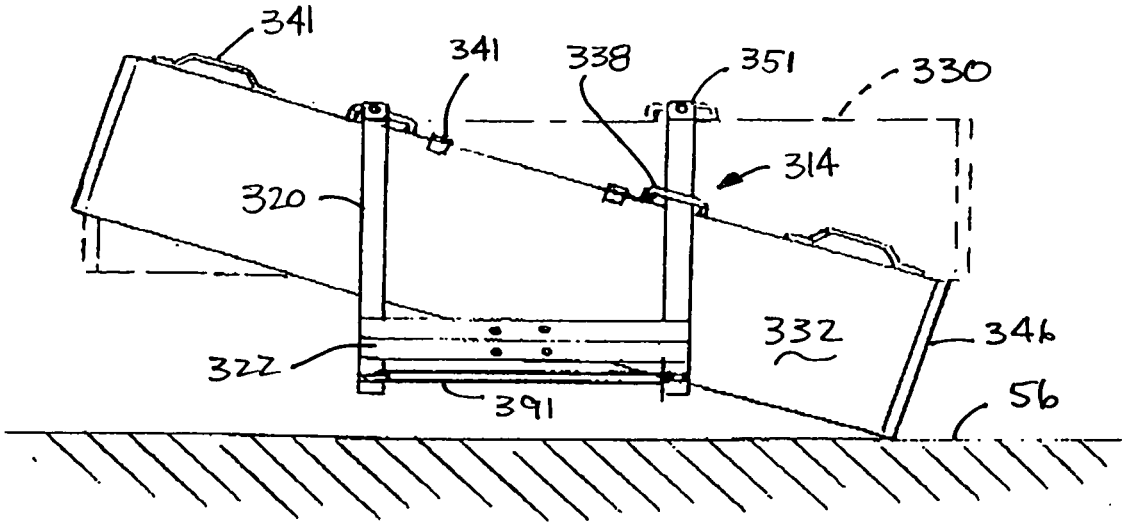
FIG. 40 is a diagrammatic view similar to that shown in FIG. 38, except that one end of the plow blade 330 is disengaged from the attachment member 351 and is disengageably secured to the mounting upright 320 and resting on the ground 56, and the plow blade 330 is shown in phantom in the non-working or transit orientation.
Figure 44:
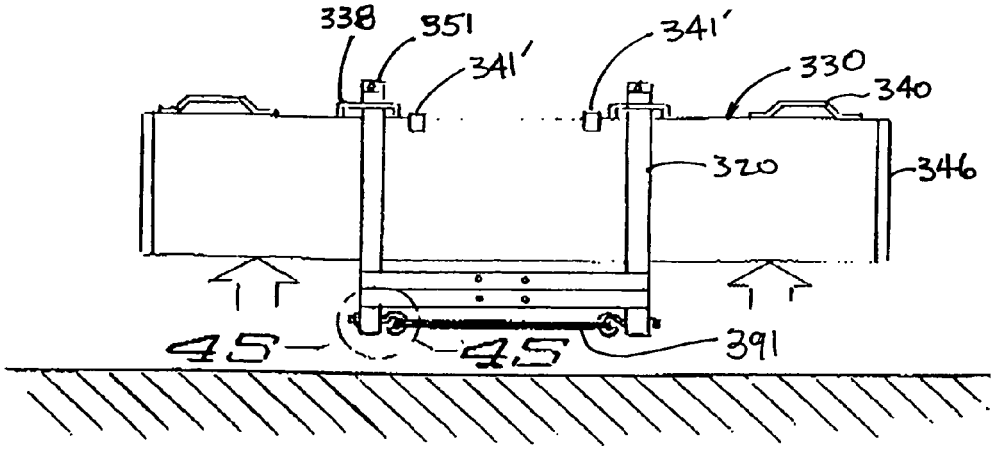
FIG. 44 is a diagrammatic view of the alternate mounting frame shown in FIG. 4, similar to that shown in FIG. 38, except that alternate attachment hooks 341, like that shown in FIG. 41B, are secured in the upper attachment channel 301 of the alternate plow blade 330 and the resilient elongated member 391 is attached to three-quarter turn eyebolts 396 secured to the inside of a bottom portion of the respective mounting uprights 320.
Figure 45:
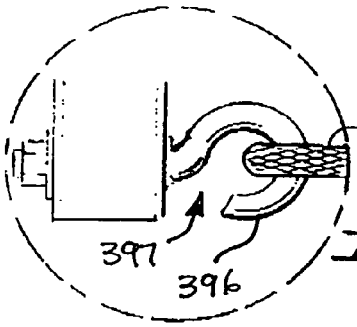
FIG. 45 is an enlargement 45—45 of the respective three-quarter turn eyebolts 396 secured to the respective mounting uprights 320, to which the resilient elongated member 391 is attached.
Figure 46:
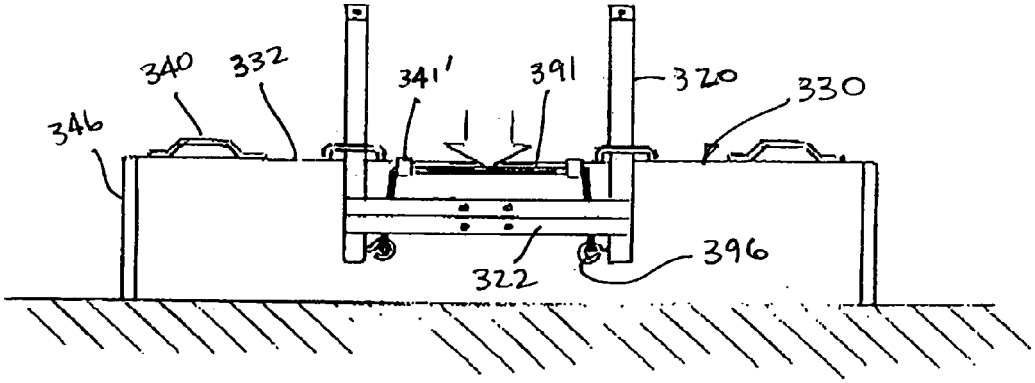
FIG. 46 is a diagrammatic view similar to that shown in FIG. 39, except that the three-quarter turn eyebolts 396 shown in FIGS. 44 and 45 are used to engage the resilient elongated member 391 to the mounting frame 320 and the resilient elongated member 391 is engaged to the alternate attachment hooks 341' shown in FIGS. 41B and 44.

Referring now also to FIGS. 44–46, a preferred downward force generating system is disclosed in which a resilient elongated member 391 is disengageably engaged with a pair of three-quarter turn eyebolts 396 secured to a lower portion of the mounting uprights 320 and retention hooks 341' such as those shown in FIG. 40 are attached to the plow blade 330. In this preferred embodiment, the resilient elongated member 391 may be engaged and disengaged from each of the three-quarter turn eyebolts 391 and each of the three-quarter turn retention hooks 341' provided. In this way, the elongated retention member 391 will be easily replaceable and may be removed for storage when not in use. Because the climates in which snow plows are used experience significant fluctuations in temperature, having a disengageable resilient elongated member 391 is likely to increase the ability of the owner to store the elongated member 391 at moderate temperatures that are less likely to advance deterioration of resilient material such as may be used for the resilient elongated material when such materials are exposed to either high or low temperatures. As shown in FIGS. 44–46, the three-quarter turn eyebolts are turned downward so that the opening 397 faces away from the retention hooks 341' when the plow blade 330 is in the working orientation shown in FIG. 46, just as the retention hooks 341' face away from the three-quarter eyebolts 396, such that the opening 395 faces away from the eyebolts 396. This permits the rapid attachment of the resilient elongated member 391 in a manner that is not disruptive of normal use of the snow plow 310.

It will be appreciated that the elongated member 391 can be any resilient elongated member that can be stretched in order to preload the elongated member so that the elongated member will place a downward force on the plow blade 330 when the elongated member 391 is engaged with elements of the mounting apparatus 314 and elements of the plow blade 330 that are positioned with respect to each other in a manner placing the engagement elements of the mounting apparatus below the engagement elements of the plow blade when the plow blade is in a working orientation as shown in FIG. 46. Because the plow blade is necessarily a relatively light piece of equipment, so that it can be easily handled by consumers, it can ride up on the mounting uprights 320 in a manner that makes it difficult to move large amounts of snow under certain circumstances. Rather than add weight to the plow blade 330 that would make the plow blade more difficult for an individual to manipulate, it is believed that it is advantageous to provide a resilient elongated member 391, such as those disclosed, that can be engaged between the mounting apparatus and the plow blade to create a downward force of the plow blade 330 during snow plowing operations when the plow blade 330 is in a working or operational orientation.

It will be appreciated that any elongated member that has some elasticity and can stretch and then apply a force upon an object to which it is connected, or more particularly, two objects between which it is connected, can be used, notably materials that are used to make shock chords, bungi cords and the like. In addition, elongated members that have only a small section, or perhaps a plurality of small sections which are resilient may certainly be used in the place of a single long elongated member that is resilient and therefore stretchable throughout its length. In addition, using a plurality of elongated members, interconnected with only a single engaging element on each of the structures to be interconnected, e.g., the mounting apparatus 314 and the plow blade 330, may also be used. In this regard, it will be appreciated that the only requirement of the engagement of the resilient elongated member or members is that they are interconnected between the mounting apparatus 314 and the plow blade 330 when the plow blade is in the working orientation. It will be appreciated that springs, rubber bands, and other resilient devices may be substituted for the preferred resilient elongated member 391 disclosed in the drawings. The preferred resilient elongated member 391 will be a shock chord having a diameter of from about an eighth of an inch to about an inch preferably from about three eighths of an inch to about a half an inch more preferably about a quarter of an inch in diameter. Extensible of resilient chord material or straps of any kind, springs and other elongated materials that can be stretched or preloaded to create a force that can be arranged to place a downward force on the plow blade 330 when the elongated material is interconnected between the mounting apparatus 314 and the plow blade 330 may be used as a resilient elongated member 391 of the present invention. It will be appreciated that multiple resilient elongated members may also be used and the arrangement for interconnecting the plow blade 330 and the mounting apparatus 314 may take any conceivable configuration.

Figure 47:
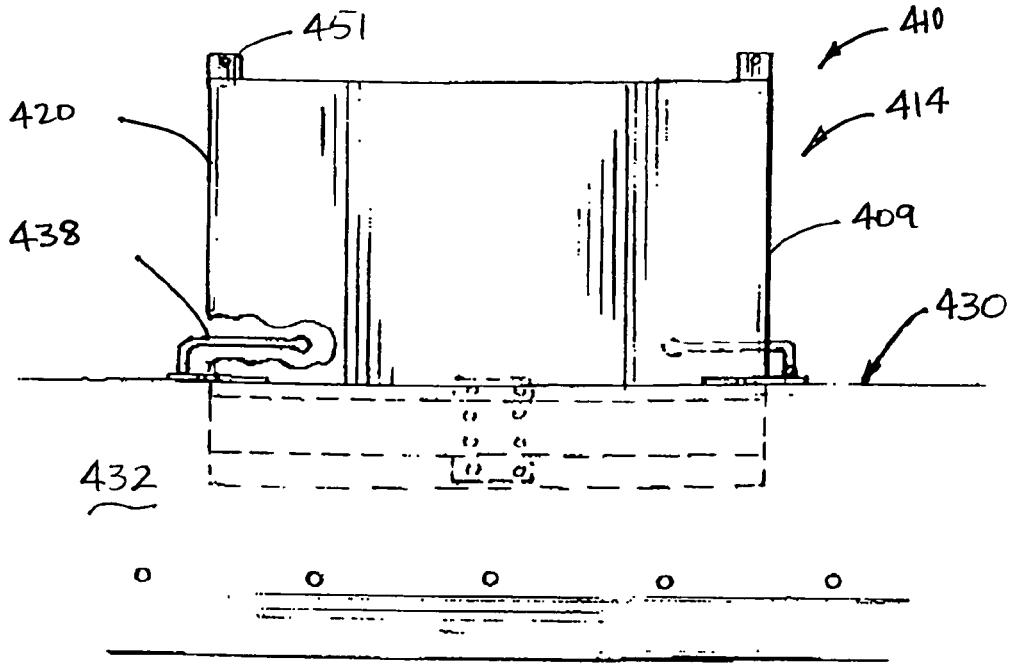
FIGS. 47 and 48 are front elevations of an alternate mounting apparatus 414 (which is partially broken away in FIG. 47) of the present invention shown with alternate plow blades 430, 430' that are partially shown, except that alternate retention members 438 and 438' that are shown partially in phantom, as are parts of the mounting apparatus 414.
Figure 48:
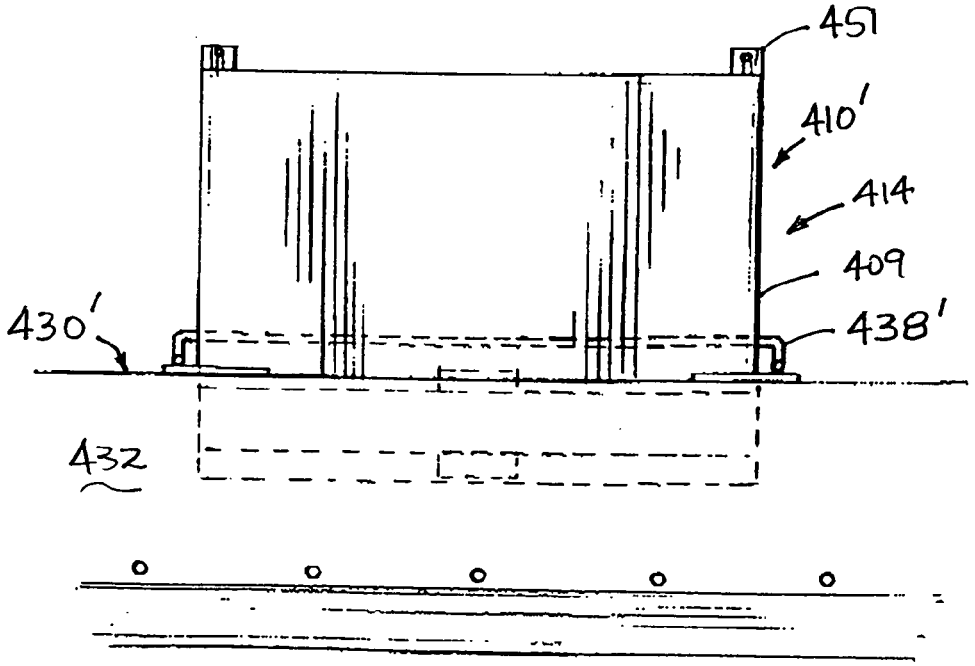

Referring now also to FIGS. 47 and 48, in certain alternate embodiments, the mounting apparatus 414 of the self-adjusting snow plow 410 will include a mounting frame 409 having a single mounting upright 420, as shown in these Figures. In FIG. 47, the plow blade 430 includes a pair of retention members 438, similar to those shown in FIG. 20, that slideably and/or disengageably secure the plow blade 430 to the single mounting upright 420. In FIG. 48, the plow blade 430' includes a single retention member 438', similar to that shon in FIG. 22, the slideably and/or disengageably secures the plow blade 430' to the single mounting upright 420.

Referring now also to FIG. 40, because of the light weight of the preferred plow blades, it is relatively easy for an individual to either lift the plow blade 330 from the working orientation, when the plow blade 330 is resting on the ground 56, or to lower the plow blade 330 to a working position from a non-working orientation similar to that shown in phantom in this Figure. To move the plow blade 330 from the working orientation when the plow blade 330 is engaged with the mounting frame 309, an individual will start from a position similar to that shown in FIG. 46 and lift one end of the plow blade using a lifting handle 340, after disengageably the elongated member 391 from the plow blade 330, to raise the plow blade 320 high enough to disengage the retention member 338 from the mounting upright 320 on one side of the mounting apparatus 314 and then place the retention member 338 in the attachment member atop the mounting upright 320 on that side of the mounting apparatus 314 so that the plow blade is in a position, similar to that shown in solid line in FIG. 40, in between a non-working, transit orientation and a working orientation. To place the plow blade 330 in the non-working, transit orientation, the individual can then go to the other end of the plow blade 330 and lift that end, disengaging the second retention member 338 from the mounting upright 320 on that side of the mounting apparatus 314 and placing the second retention member 338 in the attachment member 351, so that the plow blade is in the non-working orientation shown in phantom in FIG. 40. In preferred embodiments, the steps to lower the plow blade 330 from the non-working, transit orientation to the working orientation are just the reverse. First, the retention member 338 engaged with the attachment member 351 on one side of the mounting apparatus is disengage and the retention member is slideably engaged to the mounting upright 320 on that side of the mounting apparatus 314 and the end of the plow blade 330 approximate that side of the mounting apparatus 314 is allowed to rest on the ground, so that the plow blade is oriented in the manner shown in solid line in FIG. 40. Then the individual can go to the other end of the plow blade and lift it to disengage the second retention member 338 from the attachment member 351 approximate that side of the mounting apparatus 314 and then engage the retention member 338 upon the mounting apparatus 320 and lower the second end of the plow blade 330 to the ground.

Referring now again to FIG. 24, the guide shafts 387 on each side of the plow blade are constructed and arranged to provide the operator of a vehicle pushing the plow blade 330 with markers with which to create a sight line to assist in snow plowing operations.

It will be appreciated that the plow blades 330 of the present invention will have many lengths for different purposes. For instance, snow plows for small four wheeled vehicles such as ATV's and the like may be anywhere from three and a half to six and a half feet, preferably four feet, five feet or six feet in length. Similarly, the length of the snow plows made for larger vehicle such as trucks, SUV's and the like may be from six and a half to ten and a half feet, preferably seven feet, eighth feet, eight and a half feet, nine feet or even ten feet long. In preferred embodiments, the retention member 38, 338, or slide hinge as it is sometimes called, is definitely made from rod steel that is from about three eighths to about five eighths inches in diameter, preferably about one half inch in diameter. The retention members 38, 338 are preferably welded to a steel plate or flat iron that is an eighth of an inch thick.

Referring now to FIG. 24 and FIG. 25A, the nuts 304, placed in the attachment channels 301 and 302 are preferably square notes although hex nuts can also be used. In preferred embodiments, the plow blade of the present invention may be easily assembled by assembly workers or even consumers who purchase a kit for assembly at home or at the consumer's workshop. It will be appreciated that the preferred aluminum extrusion shown in FIG. 24, does not require any drilling or placement of openings for fasteners. Although not shown, the end caps 346 will be predrilled, as will the cap plates 348. The guide shafts 387 or sight guides will also come with predrilled holes so that fasteners can be used to secure the guide shafts to the ends of the plow blade approximately the end caps 346 and the end plates 348.

It will be appreciated that the materials used in the materials described in the present application are only preferences and that the present self-adjusting snow plow apparatus 10, 310 may be made of many different materials and of materials having a wide variety of thickness' and sized dimensions.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described herein, the details may be changed without departing from the intended scope of the invention, which is defined by the attached claims.

What is claimed is:

1. A snow plow for attachment to a vehicle, the snow plow comprising:

a mounting apparatus having a mounting frame, the mounting frame including an interconnecting member and two mounting uprights; the mounting uprights being interconnected by the interconnecting member; and a plow blade, the plow blade including retention apparatus constructed and arranged to disengageably secure the plow blade to the mounting uprights during use, the plow blade including a mold board, the mold board being an aluminum extrusion having attachment channels in which parts of the plow blade can be secured.

2. The snow plow of claim 1, wherein the plow blade includes first and second attachment channels and the retention apparatus includes at least one retention member anchored in each of the attachment channels.

3. The snow plow of claim 2, wherein the retention member is a metal member securely fastened to a metal plate that conforms generally to a series of surfaces of the mold board, the metal plate having opposite ends and being anchored in each of the first and second attachment channels proximate respective opposite ends of the metal plate.

4. The snow plow of claim 3, wherein the plow blade includes first and second retention members each of which are anchored in each of the respective attachment channels.

5. The snow plow of claim 1, wherein the plow blade includes first and second end caps at opposite ends of the plow blade.

6. The snow plow of claim 1, wherein the mold board includes a channel in which a rubber scraper is secured.

7. The snow plow of claim 6, wherein the mold board is a single piece aluminum extrusion and the plow blade includes first and second end caps secured at opposite ends of the aluminum extrusion.

8. The snow plow of claim 1, wherein the retention apparatus includes two retention members, wherein each of the respective retention members at least partially encircles one of the respective mounting uprights when the snow plow is in use to plow snow and each of the respective retention members can slide upward with respect to the respective mounting upright, when the snow plow is in use, independently of the other retention member during such use.

9. The snow plow of claim 1, the vehicle connecting member including a flat connecting plate, wherein the mounting apparatus further includes a resilient rubber connecting member interspersed between the vehicle connecting member and the connecting plate.

10. The snow plow of claim 1, wherein the mounting apparatus includes connecting member and the vehicle connecting member includes a pivoting swivel mechanism that allows the mounting frame to swivel in a generally horizontal plane when interconnected with the vehicle.

11. The snow plow of claim 1, wherein the plow includes a mold board channel within which a rubber scraper is secured.

12. The snow plow of claim 11, the rubber scraper extending away from the mold board at least about 3.5 inches.

13. The snow plow of claim 1, wherein the each of the respective mounting uprights include an upper portion having an attachment member for retaining the retention apparatus when the plow blade is not in use; wherein the plow blade can be secured to the respective mounting uprights when the plow blade is not in use by manipulating the plow blade in such a way so as to place one of a plurality of portions of the retention apparatus in each of the respective attachment members, such that respective portions of the retention apparatus are retained within the respective attachment member.

14. The snow plow of claim 13, wherein each of the respective attachment members includes a depression in which respective portions of the retention apparatus can reside when the retention apparatus is engaged with the respective attachment members.

15. The snow plow of claim 1, wherein the retention apparatus includes a retention member, wherein the retention member at least partially encircles at least one of the respective mounting uprights when the snow plow is in use to plow snow and the retention member can slide upward with respect to the respective mounting upright, when the snow plow is in use.

16. The snow plow of claim 15, wherein the retention member at least partially encircles each of the respective mounting uprights when the snow plow is in use to plow snow and the retention member can slide upward with respect to each of the respective mounting uprights, when the snow plow is in use.

17. The snow plow of claim 1, wherein the mounting apparatus includes a vehicle connecting member constructed and arranged to be securable to the vehicle.

18. The snow plow of claim 17, wherein the vehicle connecting member is interconnected to the mounting frame.

19. The snow plow of claim 18, wherein the vehicle connecting member is a hitch tongue.

20. A snow plow for attachment to a vehicle, the snow plow comprising:

a mounting apparatus having a mounting frame, the mounting frame including an interconnecting member and two mounting uprights; the mounting uprights being interconnected by the interconnecting member; and a plow blade, the plow blade including retention apparatus constructed and arranged to slideably secure the plow blade to the mounting uprights during use, the plow blade including a mold board, the mold board being an aluminum extrusion having attachment channels in which parts of the plow blade can be secured.

21. The snow plow of claim 20, wherein the plow blade includes first and second attachment channels and the retention apparatus includes at least one retention member anchored in each of the attachment channels.

22. The snow plow of claim 21, wherein the retention member is a metal member securely fastened to a metal plate that conforms generally to a series of surfaces of the mold board, the metal plate having opposite ends and being anchored in each of the first and second attachment channels proximate respective opposite ends of the metal plate.

23. The snow plow of claim 22, wherein the plow blade includes first and second retention members each of which are anchored in each of the respective attachment channels.

24. The snow plow of claim 20, wherein the plow blade includes first and second end caps at opposite ends of the plow blade.

25. The snow plow of claim 20, wherein the plow blade includes a mold board providing a channel in which a rubber scraper is secured.

26. The snow plow of claim 25, wherein the mold board is a single piece aluminum extrusion and the plow blade includes first and second end caps secured at opposite ends of the aluminum extrusion.

27. The snow plow of claim 20, wherein the retention apparatus includes two retention members, wherein each of the respective retention members at least partially encircles one of the respective mounting uprights when the snow plow is in use to plow snow and each of the respective retention members can slide upward with respect to the respective mounting upright, when the snow plow is in use, independently of the other retention member during such use.

28. The snow plow of claim 20, the vehicle connecting member including a flat connecting plate, wherein the mounting apparatus further includes a resilient rubber connecting member interspersed between the vehicle connecting member and the connecting plate.

29. The snow plow of claim 20, wherein the mounting apparatus includes connecting member and the vehicle connecting member includes a pivoting swivel mechanism that allows the mounting frame to swivel in a generally horizontal plane when interconnected with the vehicle.

30. The snow plow of claim 20, wherein the plow includes a mold board channel within which a rubber scraper is secured.

31. The snow plow of claim 30, the rubber scraper extending away from the mold board at least about 3.5 inches.

32. The snow plow of claim 20, wherein the each of the respective mounting uprights include an upper portion having an attachment member for retaining the retention apparatus when the plow blade is not in use; wherein the plow blade can be secured to the respective mounting uprights when the plow blade is not in use by manipulating the plow blade in such a way so as to place one of a plurality of portions of the retention apparatus in each of the respective attachment members, such that respective portions of the retention apparatus are retained within the respective attachment member.

33. The snow plow of claim 32, wherein each of the respective attachment members includes a depression in which respective portions of the retention apparatus can reside when the retention apparatus is engaged with the respective attachment members.

34. The snow plow of claim 20, wherein the retention apparatus includes a retention member, wherein the retention member at least partially encircles at least one of the respective mounting uprights when the snow plow is in use to plow snow and the retention member can slide upward with respect to the respective mounting upright, when the snow plow is in use.

35. The snow plow of claim 34, wherein the retention member at least partially encircles each of the respective mounting uprights when the snow plow is in use to plow snow and the retention member can slide upward with respect to each of the respective mounting uprights, when the snow plow is in use.

36. The snow plow of claim 20, wherein the mounting apparatus includes a vehicle connecting member constructed and arranged to be securable to the vehicle.

37. The snow plow of claim 36, wherein the vehicle connecting member is interconnected to the mounting frame.

38. The snow plow of claim 37, wherein the vehicle connecting member is a hitch tongue.

39. A snow plow for attachment to a vehicle, the snow plow comprising:

a mounting apparatus having a mounting frame, the mounting frame including two interconnected mounting uprights;

a plow blade, the plow blade including retention apparatus constructed and arranged to disengageably secure the plow blade to the mounting uprights during use; and an elongated member constructed and arranged to place downward force upon the plow blade when the plow blade is disengageably secured to the mounting uprights during use and the elongated member is interconnected between the plow blade and the mounting apparatus.

40. The snow plow of claim 39, wherein the elongated member is a resilient chord that is stretchable.

41. The snow plow of claim 40, wherein the plow blade includes a pair of hooks secured thereto and the elongated member is secured to the mounting frame and stretched to engage the respective hooks to put downward force on the plow blade during use.

42. The snow plow of claim 39, wherein the plow blade including a mold board, the mold board being an aluminum extrusion having attachment channels in which parts of the plow blade can be secured.

43. The snow plow of claim 42, wherein the plow blade includes first and second attachment channels and the retention apparatus includes at least one retention member anchored in each of the attachment channels.

44. The snow plow of claim 43, wherein the retention member is a metal member securely fastened to a metal plate that conforms generally to a series of surfaces of the mold board, the metal plate having opposite ends and being anchored in each of the first and second attachment channels proximate respective opposite ends of the metal plate.

45. The snow plow of claim 44, wherein the plow blade includes first and second retention members each of which are anchored in each of the respective attachment channels.

46. The snow plow of claim 39, wherein the plow blade includes first and second end caps at opposite ends of the plow blade.

47. The snow plow of claim 39, wherein the mold board includes a channel in which a rubber scraper is secured.

48. The snow plow of claim 47, wherein the mold board is a single piece aluminum extrusion and the plow blade includes first and second end caps secured at opposite ends of the aluminum extrusion.

49. The snow plow of claim 39, wherein the retention apparatus includes two retention members, wherein each of the respective retention members at least partially encircles one of the respective mounting uprights when the snow plow is in use to plow snow and each of the respective retention members can slide upward with respect to the respective mounting upright, when the snow plow is in use, independently of the other retention member during such use.

50. The snow plow of claim 39, the vehicle connecting member including a flat connecting plate, wherein the mounting apparatus further includes a resilient rubber connecting member interspersed between the vehicle connecting member and the connecting plate.

51. The snow plow of claim 39, wherein the mounting apparatus includes connecting member and the vehicle connecting member includes a pivoting swivel mechanism that allows the mounting frame to swivel in a generally horizontal plane when interconnected with the vehicle.

52. The snow plow of claim 39, wherein the plow includes a mold board channel within which a rubber scraper is secured.

53. The snow plow of claim 52, the rubber scraper extending away from the mold board at least about 3.5 inches.

54. The snow plow of claim 39, wherein the each of the respective mounting uprights include an upper portion having an attachment member for retaining the retention apparatus when the plow blade is not in use; wherein the plow blade can be secured to the respective mounting uprights when the plow blade is not in use by manipulating the plow blade in such a way so as to place one of a plurality of portions of the retention apparatus in each of the respective attachment members, such that respective portions of the retention apparatus are retained within the respective attachment member.

55. The snow plow of claim 54, wherein each of the respective attachment members includes a depression in which respective portions of the retention apparatus can reside when the retention apparatus is engaged with the respective attachment members.

56. The snow plow of claim 39, wherein the retention apparatus includes a retention member, wherein the retention member at least partially encircles at least one of the respective mounting uprights when the snow plow is in use to plow snow and the retention member can slide upward with respect to the respective mounting upright, when the snow plow is in use.

57. The snow plow of claim 56, wherein the retention member at least partially encircles each of the respective mounting uprights when the snow plow is in use to plow snow and the retention member can slide upward with respect to each of the respective mounting uprights, when the snow plow is in use.

58. The snow plow of claim 39, wherein the mounting apparatus includes a vehicle connecting member constructed and arranged to be securable to the vehicle.

59. The snow plow of claim 58, wherein the vehicle connecting member is interconnected to the mounting frame.

60. The snow plow of claim 59, wherein the vehicle connecting member is a hitch tongue.

61. A snow plow for attachment to a vehicle, the snow plow comprising:

a mounting apparatus having a mounting frame, the mounting frame including two interconnected mounting uprights;

a plow blade, the plow blade including retention apparatus constructed and arranged to slideably secure the plow blade to the mounting uprights during use; and an elongated member constructed and arranged to place downward force upon the plow blade when the plow blade is slideably secured to the mounting uprights during use and the elongated member is interconnected between the plow blade and the mounting apparatus.

62. The snow plow of claim 61, wherein the elongated member is a resilient chord that is stretchable.

63. The snow plow of claim 62, wherein the plow blade includes a pair of hooks secured thereto and the elongated member is secured to the mounting frame and stretched to engage the respective hooks to put downward force on the plow blade during use.

64. The snow plow of claim 63, wherein the plow blade including a mold board, the mold board being an aluminum extrusion having attachment channels in which parts of the plow blade can be secured.

65. The snow plow of claim 61, wherein the plow blade includes first and second attachment channels and the retention apparatus includes at least one retention member anchored in each of the attachment channels.

66. The snow plow of claim 65, wherein the retention member is a metal member securely fastened to a metal plate that conforms generally to a series of surfaces of the mold board, the metal plate having opposite ends and being anchored in each of the first and second attachment channels proximate respective opposite ends of the metal plate.

67. The snow plow of claim 66, wherein the plow blade includes first and second retention members each of which are anchored in each of the respective attachment channels.

68. The snow plow of claim 61, wherein the plow blade includes first and second end caps at opposite ends of the plow blade.

69. The snow plow of claim 61, wherein the plow blade includes a mold board providing a channel in which a rubber scraper is secured.

70. The snow plow of claim 69, wherein the mold board is a single piece aluminum extrusion and the plow blade includes first and second end caps secured at opposite ends of the aluminum extrusion.

71. The snow plow of claim 61, wherein the retention apparatus includes two retention members, wherein each of the respective retention members at least partially encircles one of the respective mounting uprights when the snow plow is in use to plow snow and each of the respective retention members can slide upward with respect to the respective mounting upright, when the snow plow is in use, independently of the other retention member during such use.

72. The snow plow of claim 61, the vehicle connecting member including a flat connecting plate, wherein the mounting apparatus further includes a resilient rubber connecting member interspersed between the vehicle connecting member and the connecting plate.

73. The snow plow of claim 61, wherein the mounting apparatus includes connecting member and the vehicle connecting member includes a pivoting swivel mechanism that allows the mounting frame to swivel in a generally horizontal plane when interconnected with the vehicle.

74. The snow plow of claim 61, wherein the plow includes a mold board channel within which a rubber scraper is secured.

75. The snow plow of claim 74, the rubber scraper extending away from the mold board at least about 3.5 inches.

76. The snow plow of claim 61, wherein the each of the respective mounting uprights include an upper portion having an attachment member for retaining the retention apparatus when the plow blade is not in use; wherein the plow blade can be secured to the respective mounting uprights when the plow blade is not in use by manipulating the plow blade in such a way so as to place one of a plurality of portions of the retention apparatus in each of the respective attachment members, such that respective portions of the retention apparatus are retained within the respective attachment member.

77. The snow plow of claim 76, wherein each of the respective attachment members includes a depression in which respective portions of the retention apparatus can reside when the retention apparatus is engaged with the respective attachment members.

78. The snow plow of claim 61, wherein the retention apparatus includes a retention member, wherein the retention member at least partially encircles at least one of the respective mounting uprights when the snow plow is in use to plow snow and the retention member can slide upward with respect to the respective mounting upright, when the snow plow is in use.

79. The snow plow of claim 78, wherein the retention member at least partially encircles each of the respective mounting uprights when the snow plow is in use to plow snow and the retention member can slide upward with respect to each of the respective mounting uprights, when the snow plow is in use.

80. The snow plow of claim 61, wherein the mounting apparatus includes a vehicle connecting member constructed and arranged to be securable to the vehicle.

81. The snow plow of claim 80, wherein the vehicle connecting member is interconnected to the mounting frame.

82. The snow plow of claim 81, wherein the vehicle connecting member is a hitch tongue.

83. A method of plowing snow, comprising the steps of:

providing a vehicle and a snow plow for attachment to a vehicle, the snow plow including: a mounting apparatus having a mounting frame, the mounting frame including two interconnected mounting uprights; a plow blade, the plow blade including retention apparatus constructed and arranged to slideably secure the plow blade to the mounting uprights during use; and an elongated member constructed and arranged to place downward force upon the plow blade when the plow blade is slideably secured to the mounting uprights during use and the elongated member is interconnected between the plow blade and the mounting apparatus;

engaging the mounting uprights with the retention apparatus such that the plow blade is in a working orientation; and attaching the elongated member to both of the mounting apparatus and the plow blade such that the elongated member places downward force upon the plow blade during use.

84. The method of plowing snow of claim 83, wherein the elongated member is a resilient chord that is stretchable and the step of attaching includes stretching the resilient chord.

85. The method of plowing snow of claim 84, wherein the plow blade includes a pair of hooks secured thereto and the step of attaching includes stretching the elongated member between the mounting frame and respective hooks to put downward force on the plow blade.

* * * * *